United States Patent [19]

Vitaliani et al.

[11] 4,396,836

[45] Aug. 2, 1983

[54] AUTOMATED CONTOUR DEBURRING APPARATUS

[76] Inventors: Ernest M. Vitaliani, 2145 Emmons Ave., Dayton, Ohio 45420; Gordon E. Mayer, 4503 Elmshaven Dr., Dayton, Ohio 45424

[21] Appl. No.: 271,878

[22] Filed: Jun. 9, 1981

[51] Int. Cl.[3] ..... G01B 11/24; B24B 19/00

[52] U.S. Cl. ..... 250/223 R; 356/376; 51/165.92; 250/560

[58] Field of Search ..... 250/223, 560; 356/376, 356/377; 51/165.92, 165.77

[56] References Cited

U.S. PATENT DOCUMENTS

| | | | |
|---|---|---|---|
| 3,529,169 | 9/1970 | Heaney et al. | 250/223 |
| 3,564,270 | 2/1971 | Eggert | 250/223 |
| 3,948,001 | 4/1976 | Miyazawa et al. | 51/165.92 |

OTHER PUBLICATIONS

Cochran, J. F. "Deburring: Some of the Problems and Requirements of the Aircraft Industry", SME Technical Paper MR76–547 (1976).

Sommer & Maca Industries, Inc. literature (14 pages) on SOMACA sheet deburring machine (1976).

*Primary Examiner*—David C. Nelms
*Assistant Examiner*—Edward P. Westin
*Attorney, Agent, or Firm*—Donald J. Singer; John R. Flanagan

[57] ABSTRACT

An automated part contour deburring apparatus has a deburring station which includes a pair of deburring brushes with a pair of gripping rollers disposed on either side of the brushes. The brushes and rollers in the respective pairs thereof are movably adjustable toward and away from each other simultaneously as they cooperate to transfer a part through the station. The adjustment to the positions of the brushes and rollers is determined through operation of stepping motors by a microprocessor-based controller. The contour profile of the part is sensed by banks of light emitters and detectors as the part is fed into the station. The controller repetitively reads the part contour profile and operates the motors to adjust the positions of the brushes and rollers so that they will accommodate the profile of the part as it moves through the station.

11 Claims, 19 Drawing Figures

POWER DOWN

INITIALIZE MICROPROCESSOR

LIGHTS OK?

ROM OK?

STORE

READ AND STORE LIGHTS (BANK 2)

READ AND STORE LIGHTS (BANK 1)

AUTOMATED CONTOUR DEBURRING APPARATUS

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to deburring of component parts having flat and/or curved configurations, such as aircraft fuselage panels or the like, and, more particularly, is concerned with an automated contour deburring apparatus wherein the profiles of component parts of varying sizes and shapes are sensed and accommodated without the necessity for human intervention.

2. Description of the Prior Art

Deburring of metal and plastic parts must be accomplished for two principal reasons: (1) material handling problems, and (2) part misalignment problems in tooling setups. Manual handling of parts with sharp, exposed edges, for instance, in transfer between stages of a manufacturing operation, presents a safety hazard. Also, burrs of sufficient size and/or quantity can cause misalignment in tooling fixtures. This condition can cause part scrappage and costly rework.

To avoid these problems, manual deburring is undertaken often and at considerable cost. One major disadvantage of manual deburring is that frequently repetitive setups must be made in order to accomplish deburring of a part. This consumes an inordinate amount of time. For example, a ninety-degree formed part may have to be set up a half dozen times before the deburring operation is completed. In the aircraft industry, especially, by virtue of the large number of parts required to construct an aircraft, manual deburring of parts is a significantly large cost factor.

Although factories have been equipped with various types of deburring machines for some time, many parts still have to be deburred by hand because their thickness, size or other factors make them unsuitable for the mechanized techniques. Deburring machines in current use are mainly of the specialty type, being limited to a single part having a uniform thickness and flat configuration or to a family of geometrically-similar parts. No machinery having general application presently exists.

Therefore, the need exists for a safe, automated deburring technique having broad application to parts of widely ranging contours and configurations wherein the necessity for manual human intervention is minimized, if not eliminated entirely.

SUMMARY OF THE INVENTION

The present invention provides an automated contour deburring apparatus intended to satisfy the aforementioned need. The apparatus will automatically accommodate dissimilar parts of various shapes and sizes in succession without frequent setup adjustments being necessary. Human intervention is not required beyond monitoring of the deburring operation as parts are placed on the conveyor for feeding them into the deburring station of the apparatus. As a result, a variety of parts can now be mechanically deburred which heretofore required the use of manual labor or inefficient machinery. The unique technique underlying the present invention which facilitates the automated deburring of dissimilar parts is the step of sensing the particular contour profile of a part precedent to its being fed into the deburring station, followed by the step of utilizing this information on the part profile at the proper time to cause adjustment of mechanisms located in the station such that the part is effectively deburred while it is transferred under control through the station.

Accordingly, the present invention is directed to an apparatus for deburring parts of varying sizes and shapes, which comprises the combination of: (a) a part deburring station having an entrance and exit; (b) means located adjacent the entrance of the station for feeding a part into the station; (c) means located adjacent the exit of the station for transporting the part from the station; (d) means positioned adjacent the part feeding means for sensing the contour profile of the part being fed into the station; (e) means mounted in the station for gripping the part and simultaneously transferring it through the station from the part feeding means to the part transporting means; (f) means mounted in the station for deburring the part as it is being transferred through the station by the part gripping means; and (g) control means interconnecting the part contour profile sensing means to the gripping means and to the deburring means, and operable in response to the sensing of the contour profile of the part for adjusting the gripping means and the deburring means to accommodate the particular size and shape of the part as it is transferred through the station.

DETAILED DESCRIPTION OF THE INVENTION

IN GENERAL

Figure 1:
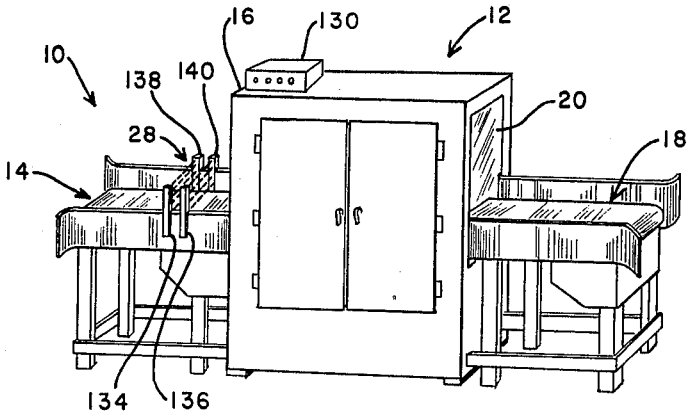
FIG. 1 is a perspective view of the automated contour deburring apparatus of the present invention.
Figure 3:
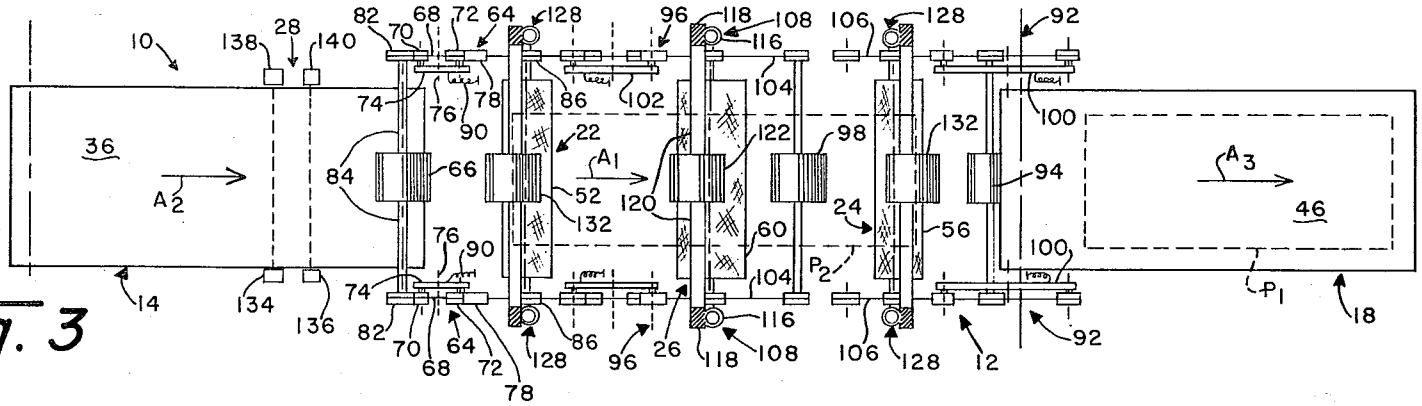
FIG. 3 is a top plan view of the apparatus shown in FIG. 2.
Figure 2:
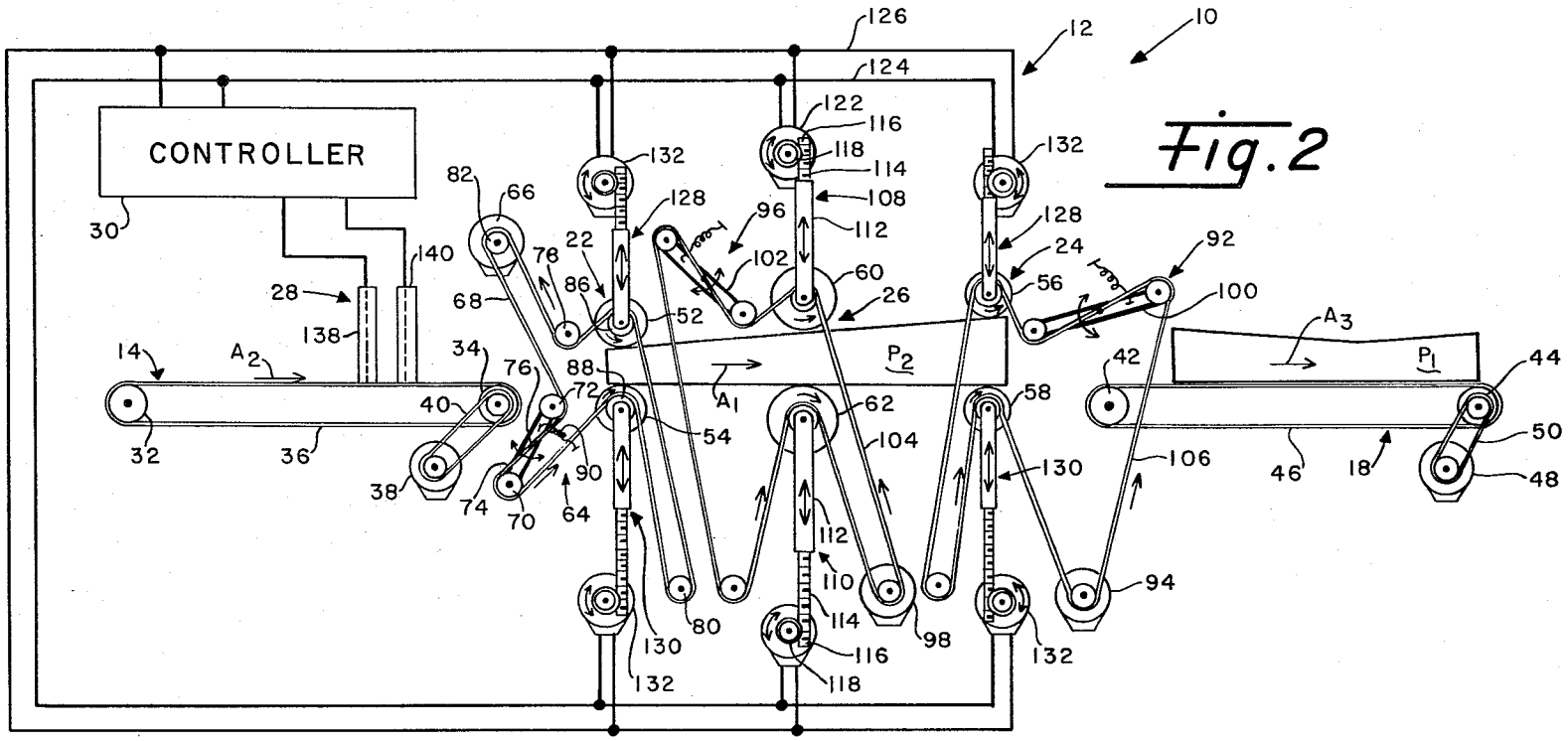
FIG. 2 is a side elevational view, in schematic form, of the basic mechanical mechanisms of the deburring apparatus.

Referring now to the drawings, and particularly to FIGS. 1 through 3, there is shown the preferred embodiment of the automated contour deburring apparatus of the present invention, being generally designated 10.

The deburring apparatus 10 includes a part deburring station 12, with means in the form of conveyor 14 located adjacent an entrance 16 to the station 12 for feeding a part into the station and means in the form of conveyor 18 located adjacent an exit 20 from the station 12 for transporting the part from the station. In FIG. 2 in solid line form and FIG. 3 in dashed line form, a part $P_1$ is shown on transporting conveyor 18, while another part $P_2$ is shown within the station 12. Mounted within the station 12 for controlling the transfer of part $P_2$ therethrough is means in the form of a pair of sets of part gripping rollers 22 and 24. Gripping roller set 22 is mounted in the station 12 adjacent the entrance 16 for clamping or gripping the part $P_2$ and simultaneously feeding or transferring it in the direction of an arrow $A_1$ through the station to the part transporting conveyor 18. Mounted within the station 12 intermediately between the gripping roller sets 22, 24 is means in the form of a pair of roller brushes 26 for deburring the part $P_2$ as it is being transferred through the station 12 by the gripping roller sets 22,24.

For accommodating parts having profiles of varying sizes and shapes, such as is the case with parts $P_1$ and $P_2$, means 28 positioned adjacent the part feeding conveyor 14 senses the contour profile of the part just precedent to its being fed through the entrance 16 to the deburring station 12. A microprocessor-based controller 30 interconnects the part contour profile sensing means 28 to the gripping roller sets 22, 24 and the pair of deburring roller brushes 26 and is programmed to respond to the information sensed on the part profile by causing adjustment of the gripping roller sets 22, 24 and the pair of deburring brushes 26 on a continuous basis so as to accommodate the particular profile of the part as it is transferred through the deburring station 12. In such a manner, the part is effectively deburred while it is being transferred through the station under control at all times.

FEED AND TRANSPORT CONVEYORS

For the most part, the feeding and transporting conveyors 14, 18 are identical. Feeding conveyor 14 is comprised by a pair of idler and drive rollers 32, 34 horizontally spaced apart and, mounted on the frame of the apparatus 10 so as to rotate about parallel axes and support a continuous conveyor belt 36 which extends between and around each of the rollers. An electric motor 38 mounted on the frame of the apparatus 10 adjacent the exit end of the conveyor 14 (or entrance to the deburring station 12) is coupled to the drive roller 34 by a drive belt 40 for driving the conveyor 14 such that the upper flight of the conveyor belt 36 moves in the direction of arrow $A_2$.

Transporting conveyor 18 is comprised by a pair of idler and drive rollers 42, 44 horizontally spaced apart and mounted on the frame of the apparatus 10 so as to rotate about parallel axes and support a continuous conveyor belt 46 which extends between and around each of the rollers. An electric motor 48 mounted on the frame of the apparatus 10 adjacent the exit end of the conveyor 18 is coupled to the drive roller 44 by a drive belt 50 for driving the conveyor 18 such that the upper flight of the conveyor belt 46 moves in the direction of arrow $A_3$.

For reasons to be brought out later on in the description of other components of the apparatus 10, it is important that a part placed on conveyor 14 not slip relative to the conveyor belt 36 as it is fed to the gripping roller set 22 at the entrance 16 to the deburring station 12. Likewise, it is important that the conveyor belt 36 not slip relative to drive roller 34. Non-slippage between the part, conveyor belt and roller can be substantially ensured, for example, by application of some suitable conventional composition on the inner and outer surfaces of the conveyor belt 36 and the exterior cylindrical surface of the roller 34. Also, the speed of motor 38 must be regulated such that the rate of movement of the upper flight of the conveyor belt 36 is maintained substantially constant.

DEBURRING STATION

Similar mechanical drive and position adjusting mechanisms are associated with each of the sets of gripping rollers 22, 24 and the pair of deburring roller brushes 26 for allowing each of these components of the apparatus 10 located in the deburring station 12 to operate in two independent modes simultaneously. In one mode of operation of these components, each is rotated at a speed which will ensure that the part is transferred through the station 12 at substantially the same rate as it is fed into the station by the feeding conveyor 14. In the other mode of operation of these components, each roller 52, 54 and 56, 58 of each set 22 and 24 thereof and each brush 60, 62 of the pair 26 thereof is displaceable toward and away from the other roller of the set and brush of the pair, respectively.

The set 22 of upper and lower gripping rollers 52, 54 located adjacent the entrance 16 to the station 12 are rotatably driven at both ends in counterclockwise and clockwise directions, respectively (as seen in FIG. 3), by identical serpentine drive transmission arrangements 64 coupled to a common electric motor 66 mounted on the frame of the apparatus 10. Each serpentine drive transmission arrangement 64 includes a drive belt (or chain) 68 entrained about idlers 70, 72 rotatably mounted at opposite ends of a takeup-and-expansion arm 74 which, in turn, is rotatably mounted at 76 to the frame of the apparatus 10, a pair of stationary idlers 78, 80 rotatably mounted on the apparatus frame, a drive pulley 82 secured on an end of a rotating drive shaft 84 of the motor 68, and driven pulleys 86, 88 secured on the ends of the gripping rollers 52, 54. The takeup-and-expansion arm 74 is biased by a spring 90, anchored to the apparatus frame and attached to one end of the arm 74, to rotate in a clockwise direction, as seen in FIG. 2, so as to "wind up" the path traversed by the drive belt 68 and thereby maintain the belt in a taut condition. The arm 74 will rotate in a counterclockwise direction against the biasing force of spring 90 and "unwind" the path of the drive belt 68 as either one or both of the gripping rollers 52, 54 is moved away from the other by adjustment mechanisms to be described later. In such manner, not only can continuous change in the amount of displacement between the upper and lower gripping rollers 52, 54 be accommodated by the mechanism for rotatably driving the rollers, but also the rollers will be rotated at a constant speed irregardless of the amount of displacement between them at any particular moment.

Since the drive mechanisms for the other gripping roller set 24 and the pair of deburring brushes 26 are substantially identical in their components and operations to the drive mechanism just described for gripping roller set 22, they need not be described in detail. Suffice it to say that the set of upper and lower gripping rollers 56, 58 located adjacent the exit 20 to the station are rotatably driven at both ends in counterclockwise and clockwise directions, respectively (as seen in FIG. 3), by identical serpentine drive transmission arrangements 92 coupled to a common electrid motor 94. Similarly, the pair of upper and lower deburring brushes 60, 62 are rotatably driven at both ends in counterclockwise and clockwise directions, respective (as seen in FIG. 3), by identical serpentine drive transmission arrangements 96 coupled to a common electric motor 98. The angular rotational positions of takeup-and-expansion arms 100 and 102 of the respective serpentine drive transmission arrangements 92 and 96 for the roller set 24 and a pair of brushes 26, respectively, are such that the path of a drive belt 104 entraining the idlers on arm 102 is more unwound than that of the drive belt 68, while the path of a drive belt 106 entraining the idlers on arm 100 is more unwound than the paths of both drive belts 68 and 104. This is the case since the gripping rollers 56, 58 at the station exit 20 are displaced further apart than the deburring brushes 60, 62, which, in turn, are displaced further apart than the gripping rollers 52, 54 at the station entrance 16.

For adjusting the positions of the pair of upper and lower deburring roller brushes 60, 62, upper and lower threaded telescoping supports 108 and 110 are provided at each of the opposite ends of the brushes 60, 62. Each of the upper and lower threaded telescoping supports 108, 110 includes an internally threaded tube 112 mounted to the apparatus frame for vertical sliding movement relative thereto and an externally threaded screw 114 received in one end of the tube 112. The other end of each of the tubes 112 rotatably mounts an end of a respective one of the upper and lower brushes 60, 62. The threaded screw 114 is stationarily mounted to the apparatus frame for rotation about a vertical axis and meshed at its outer end 116 with a complementarily threaded gear 118 on an outer end of a drive shaft 120 of an electric stepping motor 122.

The direction of movement of each of the brushes 60, 62 in the vertical direction is controlled by the respective signals transmitted on lines 124, 126 from the controller 30 to the motor 122. As will be explained later in greater detail, a first signal condition on line 124 sets up motor 122 for incremental, stepped rotation of its shaft 120 in one direction whenever a signal is received by the motor 122 on the other line 126, while a second signal condition on line 124 complementary to the first signal condition sets up motor 122 for incremental, stepped rotation of its shaft in an opposite direction whenever a signal is received by the motor on the other line 126. In the first signal condition, the motor drive shaft 120 causes rotation of the screws 114 at both ends of the shaft in a first direction so as to unthread from the tubes 112 which, because the screws 114 are stationary, causes vertical movement of the tubes 114 and a respective one of the brushes 60, 62 toward the part $P_2$. In the second signal condition, the motor drive shaft 120 causes rotation of the screws 114 in a second direction opposite the first direction so as to thread further into the tubes 112 which causes vertical movement of the tubes 114 and a respective one of the brushes 60, 62 away from the part $P_2$. In such manner, the position of the brush can be continuously adjusted to accommodate the particular contour profile of the part as it is transferred past the brush.

Since the position adjusting mechanism for the gripping roller sets 22, 24 are substantially identical in their components and operations to the position adjusting mechanism just described for the pair of deburring brushes 26, they need not be described in detail. Suffice it to say that a pair of upper and lower threaded telescoping supports 128, 130 mount each of the entrance and exit sets 22, 24 of gripping rollers 52, 54 and 56, 58 for independent translatory movement of any one of the rollers in a vertical direction toward and away from the other of the set, and the part located therebetween, due to the extension and retraction of its respective one of the telescoping supports 128, 130 as determined by the electrical signal conditions received by respective electric stepping motors 132 on lines 124, 126.

PART CONTOUR PROFILE SENSING MEANS

Proper adjustment of the vertical positions of the gripping roller sets 22, 24 and deburring brush pair 26 for accommodating parts of varying sizes and shapes depends on accurate detection of the contour profile of each part by sensing means 28 as the part is fed toward the deburring station entrance 16. Sensing means 28 takes the form of first and second banks of light sources 134, 136 and light sensors 138, 140 (the light sources being omitted in FIG. 2 in order to show the sensors on the opposite side of the conveyor 14).

Preferably, each of the banks of sensors 138, 140 is comprised by a vertical column of one hundred and twenty-eight individual, linearly-arranged light detectors. Similarly, each of the banks of sources 134, 136 is comprised by a vertical column of one hundred and twenty-eight individual, linearly-arranged light emitters, each being horizontally aligned with one of the individual light detectors. The dashed lines extending between the first and second light source and sensor banks 134, 138 and 136, 140 in FIGS. 1 and 3 represent the one hundred and twenty-eight individual light beams projected between each set of banks.

In the preferred embodiment, the individual light emitters and detectors of the respective columns thereof are vertically spaced apart by one-sixteenth of an inch. The lowest emitter/detector pair is positioned one-sixteenth of an inch above the upper surface of the conveyor belt 36 and therefore the uppermost emitter/detector pair is located eight inches above the conveyor belt upper surface. Consequently, the preferred embodiment of the apparatus is limited to receiving parts which are less than eight inches in height.

CONTROLLER

Figure 4:
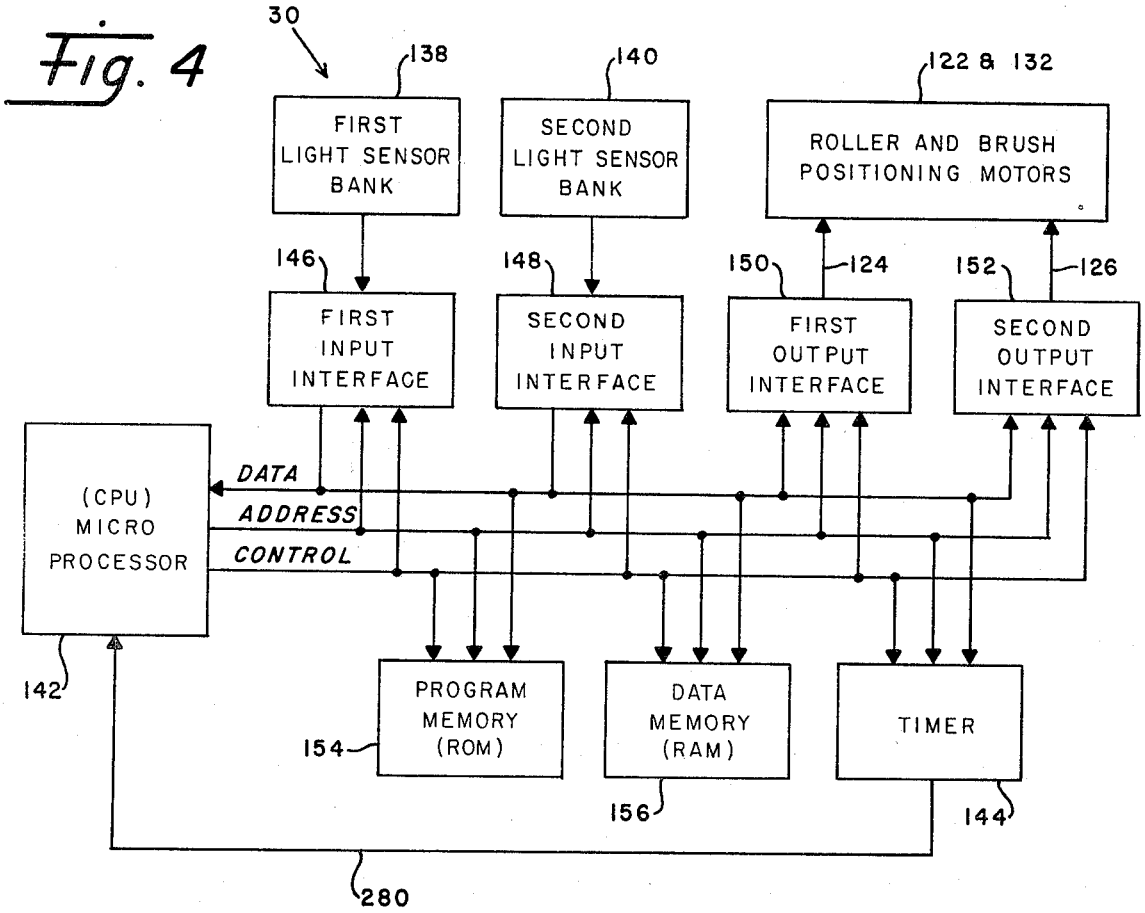
FIG. 4 is a block diagram schematic of the basic components of the controller of the deburring apparatus.

Referring now to FIG. 4, there is shown a preferred embodiment of the controller 30 for addressing the light sensor banks 138, 140, for storing and processing the data received relating to the contour profile of the part being fed to the deburring station 12, and for causing operation of the brush and roller positioning motors 122, 132 so as to correctly adjust the vertical positions of the brush pair 26 and gripping roller sets 22, 24 at the appropriate moments as the part is being transferred through the station 12. The basic components of the controller 30 are represented in block form since they are individually well known in the art, and to reproduce them in detail would only serve to increase the complexity of the explanation of the controller 30 utilized in the deburring apparatus 10 without adding to its clarity. The controller 30 may be implemented using an Intel System 80/20 microcomputer system, Intel SBC 016 16K byte RAM memory board, and Intel SBC 614 modular backplane and cardcage. Details of the Intel microcomputer system and its operation may be gained by reference to Intel 8080 Systems User's Manual (September 1975) and Intel 1977 Data Catalog.

The basic components of the controller 30 are the microprocessor (or CPU) 142, timer 144, first and second input interfaces 146, 148, first and second output interfaces 150, 152, program read-only memory (or ROM) 154 and data read/write memory (or RAM) 156. While the operation of the controller 30 will be described in detail in reference to FIGS. 5 through 18, some preliminary comments about its overall cooperation with the light sensor bank 138, 140 and roller and brush positioning motors 132 and 122 may be helpful at this point in the description of the present invention.

The preferred embodiment of the deburring apparatus 10 is set to map the contour profile of a moving part as a grid of points on the part wherein each point is separated in both horizontal and vertical directions by one-sixteenth (0.0625) of an inch. This is accomplished, first, by reading and storing the states of the light detectors in sensor banks 138, 140 ach instance the part has horizontally moved one-sixteenth of an inch and, second, due to the fact that the vertical spacing between the individual light emitters and detectors in each of the banks of light sources 134, 136 and sensors 138, 140 is also one-sixteenth of an inch.

The controller 30 is synchronized with the speeds of operation of the conveyor 14 and roller sets 22, 24, which provide horizontal movement of the part, through the use of the timer 144. The timer 144 is a programmable counter which is set to count for a given interval of time and to then interrupt the microprocessor 142 when the prescribed count is reached. By setting the counting interval of the timer 144 equal to the amount of time it takes the part being fed by the conveyor 14 and roller sets 22, 24 to travel one-sixteenth of an inch, the microprocessor will then automatically sense the portion of the part aligned with the respective column of light detectors and thereby for every one-sixteenth of an inch increment of both its length and height substantially continuously map the contour profile of the part.

Furthermore, since the distances from the light sensor bank 140 to the roller sets 22, 24 and brush pair 26 are known, the controller 30 may be programmed to recall what the profile of the part is at each of the locations of the roller sets and brush pair as the part is fed through the station 12 and operate the motors 132, 122 to independently adjust the respective vertical positions the rollers of each set thereof and the brushes in the pair thereof to continuously accommodate the part profile at those locations.

First and second input interfaces 146, 148 of the controller 30 allow the microprocessor 142 to read the light detectors of the first and second banks 138, 140 in groups of eight at a time each time the timer 144 interrupts the microprocessor 142. First and second output interfaces 150, 152 allow both directional and operational control of each of the positioning motors 122, 132 independently of one another by the microprocessor.

Data memory 156 is divided into three different arrays. A first array of the memory 156 is used to store the state of the light detectors in the first bank 138. To store the states of all sixteen groups of eight lights each requires sixteen bytes of memory capacity. However, the capacity of the first array must also be sufficient to temporarily store all of the data readings of the contour profile of the part for every one-sixteenth of an inch increment of a portion of its length equal to the distance between the first sensor bank 138 and the second sensor bank 140 plus an extra one-sixteenth of an inch of part length. If the banks are, for example, spaced five inches apart, then the first array must have the capacity to store data for eighty-one (one plus the product of five times sixteen) successive increments of the contour profile of the part. This translates into 1456 (eighty-one times sixteen) bytes of memory capacity. A second array of the memory 156 is used to store the states of the light detectors in the second sensor bank 140. The capacity of the second memory array must be sufficient to temporarily store only the data defining the contour profile at a single location at a time. As stated above, sixteen bytes of memory capacity is required to store the state of all sixteen groups of eight lights each. Therefore, the second memory array must have sixteen bytes of capacity. Finally, the third array of the memory 156 is used to store data representing whatever is occupying the space in one-sixteenth of an inch increments between the second light sensor bank 140 and the gripping roller set 24 adjacent the station exit 20. Where a part is occupying some of this space, the data will define the specific top and bottom points bounding the contour profile of the part. Where the space is empty the data will merely define such condition. Two bytes of memory capacity are required to store such specific contour profile data for each one-sixteenth of an inch increment of the distance between the second light sensor bank 140 and gripping roller set 24. If the roller set 24 is, for example, located four feet from the second bank 140, then 1536 (forty-eight times sixteen times two) bytes of memory capacity are required. The data can be recalled or retrieved from the third array of memory 156 by the microprocessor 124 when needed to control operation of the positioning motors 122, 132 at the proper instance to adjust the deburring brush pair 26 and gripping roller sets 22, 24 to accommodate the contour profile of the part being moved through the station 12.

Program memory 154 contains the program for directing the activities of the microprocessor 142 in controlling the operation of the deburring apparatus 10. The flow charts in FIGS. 5 through 18 indicate the steps of the program, in terms of what input signals must be read, what processing and computations are needed, and what output signals must be produced, at a level of detail sufficient to enable one skilled in microcomputer programming to write the program from the flow charts without undue experimentation. It is estimated that it would only take one skilled in microcomputer programming a few days to write an acceptable program by following the shorthand expression thereof contained in FIGS. 5 through 18 which will now be described in detail.

OPERATION OF THE CONTROLLER

Overview of the Program

Figure 5:
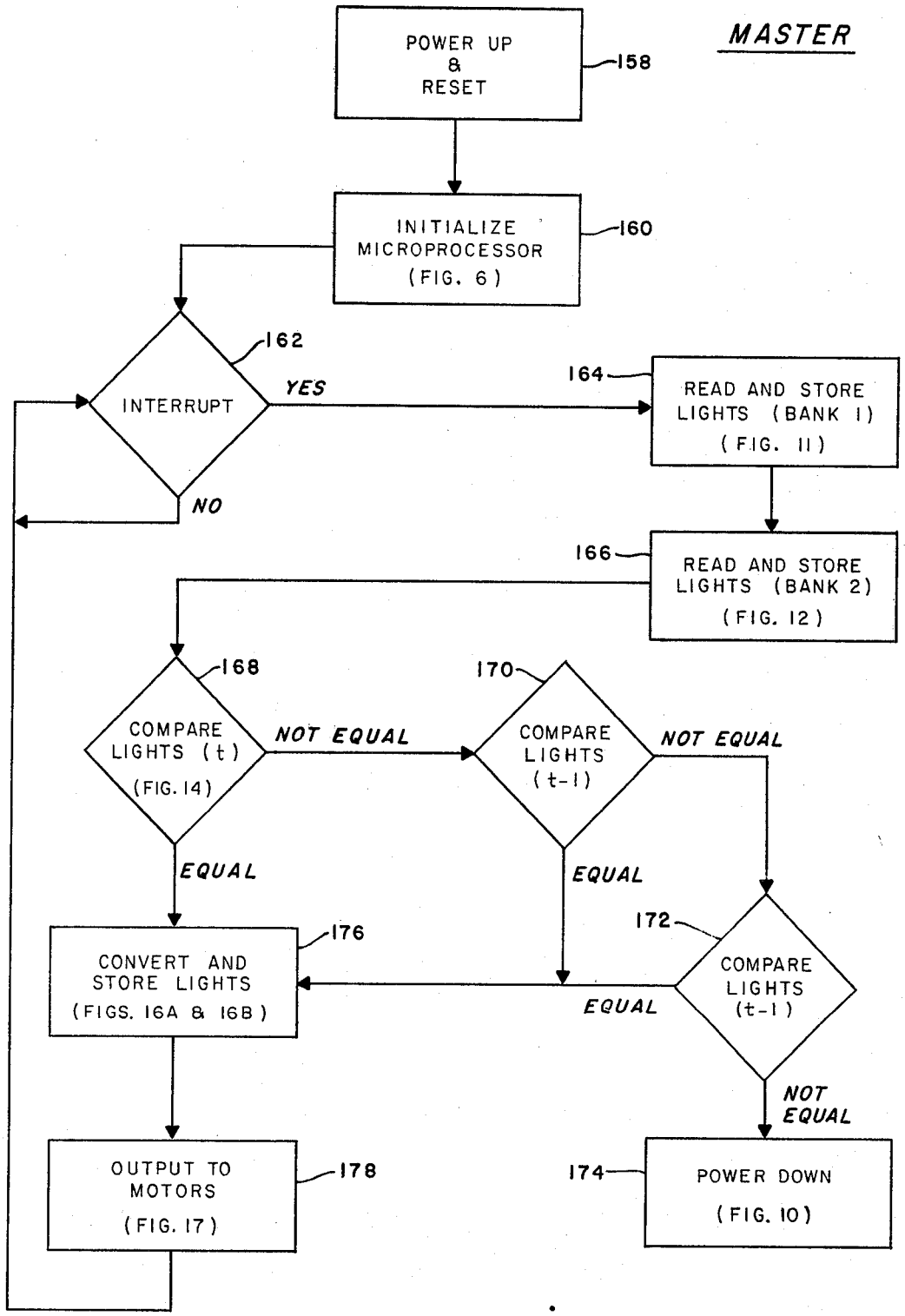
FIGS. 5 through 18 are various flow charts illustrating, in shorthand form, the program for directing the operation of the controller in conjunction with the part contour profile sensing means in adjusting the gripping and deburring mechanisms of the deburring apparatus.

Referring to FIG. 5, an overall representation of the program for directing the operation of the controller 30 is shown in flow chart form and captioned, MASTER. The controller 30 is first given power as shown per block 158. When the controller 30 is powered, a reset pulse initializes the microprocessor 142 as shown per block 160, which is a general reference to the INITIALIZE MICROPROCESSOR routine of FIG. 6. As will be described in greater detail in relation to FIGS. 6 to 9, this causes the set up of the counters within the timer 144 and checking of the light emitters and detectors of both pairs of banks 134, 138 and 136, 140, the program memory 154, and the data memory 156. Once initialization is completed, an interrupt loop, block 162, is then entered, where the microprocessor 142 awaits an interrupt signal from the timer 144.

Upon receipt of an interrupt signal, the operation of the controller 30 is set in motion by the microprocessor 142 successively entering READ AND STORE LIGHTS (Bank 1) and READ AND STORE LIGHTS (Bank 2) routines depicted generally by blocks 164 and 166 and in more detail in FIGS. 11 and 12 which will be described hereinafter. In the routine of block 164, the states of the light detectors in the first sensor bank 138 are read and stored in groups of eight detectors each in the first array of data memory 156. Following that, in the routine of block 166, the states of the light detectors in the second sensor bank 140 are read and stored in groups of eight detectors each in the second array of data memory 156.

Once these two routines are completed, the microprocessor 142 enters a COMPARE LIGHTS (t) routine (block 168) wherein the states of the light detectors of the second sensor bank 140 just read and stored are compared with the states of the light detectors of the first sensor bank 138 at some predetermined "t" time ago where "t" is the time equivalent of the distance between the banks in one-sixteenths of an inch increments. If the comparison fails (indicates that the compared states are not equal or identical), then the microprocessor 142 enters a COMPARE LIGHTS (t−1) routine (block 170) wherein the states of the light detectors of the second sensor bank 140 are now compared with the states of the light detectors of the first sensor bank 138 at "t−1" time ago (which is when the part has moved in the direction of feed one-sixteenth of an inch from its time "t" position). If the comparison again fails, then the microprocessor 142 proceeds to a COMPARE LIGHTS (t+1) routine as per block 172 for one final comparison. In the latter routine (block 172), the states of the light detectors of the second sensor bank 140 are compared with the states of the light detectors of the first sensor bank 138 at "t+1" time ago (which is when the part was located one-sixteenth of an inch from its time "t" position just prior to reaching the time "t" position). If the comparison now fails, then the microprocessor 142 proceeds to a POWER DOWN subroutine as per block 174, which is shown in detail in FIG. 10 and will be described in connection with a detailed description of the INITIALIZE MICROPROCESSOR routine of FIG. 6 which will follow shortly.

So, as just explained, potentially three separate comparison tests will be carried out on the data set of sixteen bytes temporarily stored in the second array of the data memory 156. The details of the routines for performing these comparisons will be explained later on with reference to FIGS. 14 and 15. The purpose of the tests is to confirm or verify that the reading now taken at light bank 140 is a data set which contains within it a subset of data defining the top and bottom points bounding the contour profile of the part at a particular one-sixteenth of an inch increment of its length and not just some erroneous or random information due to light malfunction. The data set at "t" time used in the first comparison (block 168) should have defined substantially the same contour profile of the part at the first light sensor bank 138 as has now been defined at the second light sensor bank 140. However, if the contour profile of the part happens to contain a steep inclination at some location along its length, it is possible, due to the interactions of the speed of light detector response and of movement of the part, for the first comparison test to indicate unequal data. This means that a different sequence of light detectors were read as being off in the latest reading than read as being off in the earlier "t" time reading. In such situation, it is not possible without additional information to know whether either set of data relates to the part contour profile or not. Therefore, the second, and if necessary third, comparison test is made. The two comparison tests check the reading taken at bank 140 with readings taken previously (and stored in the first array of memory 156) at bank 138 at one-sixteenth of an inch increments on either side of the location on the part where the reading has now been taken at bank 140. In this way, if the reading at light bank 140 was not faulty, then one or the other of the second or third comparisons will be equal to the bank 140 reading and thus verify that the data set read at light 140 is actually contour profile information. If the comparisons are both unequal, then the bank 140 reading was faulty. The microprocessor 142 then enters the POWER DOWN subroutine which shuts down operation of the deburring apparatus 10.

If the first comparison produces a match or a condition of equality between the two sets of data, then the microprocessor 142 enters a CONVERT AND STORE LIGHTS routine as per block 176. The necessity for the second and third comparisons is obviated. However, if the first comparison did not match, but the second comparison did produce a match, then the microprocessor enters the routine of block 176. Likewise, if the second comparison did not result in a match, but the third comparison did, then the microprocessor would enter the routine of block 176.

The CONVERT AND STORE LIGHTS routine (block 176), to be described later on in reference to FIGS. 16A and 16B, basically examines the set of data by a procedure which is equivalent to scanning the column of light detectors of the second bank 140. First, the light detector column is scanned from the bottom up to find the location of the first light detector that is not conductive. Its position represents the location of the bottom of the contour profile of the part. Second, the light detector column is scanned from the top down to find the location of the first light detector that is not conductive. Its position represents the location of the top of the contour profile of the part. In actuality this procedure is carried out by the microprocessor 142 scanning the set of data stored in the second array of data memory 156. The subset of data found to contain the bottom and top boundary points are then stored in the third array of memory 156 by the microprocessor 142. As mentioned previously, such data subset requires only two bytes of memory capacity. This overall procedure of scanning the data set and storing only the specific subset of data representing the bottom and top profile boundary points may be referred to as "compaction" of the data set. Once data compaction is completed, the data set of the second array is no longer needed and will be destroyed upon the next succeeding reading and storage of the states of the light detectors of the second bank 140.

Figure 18:
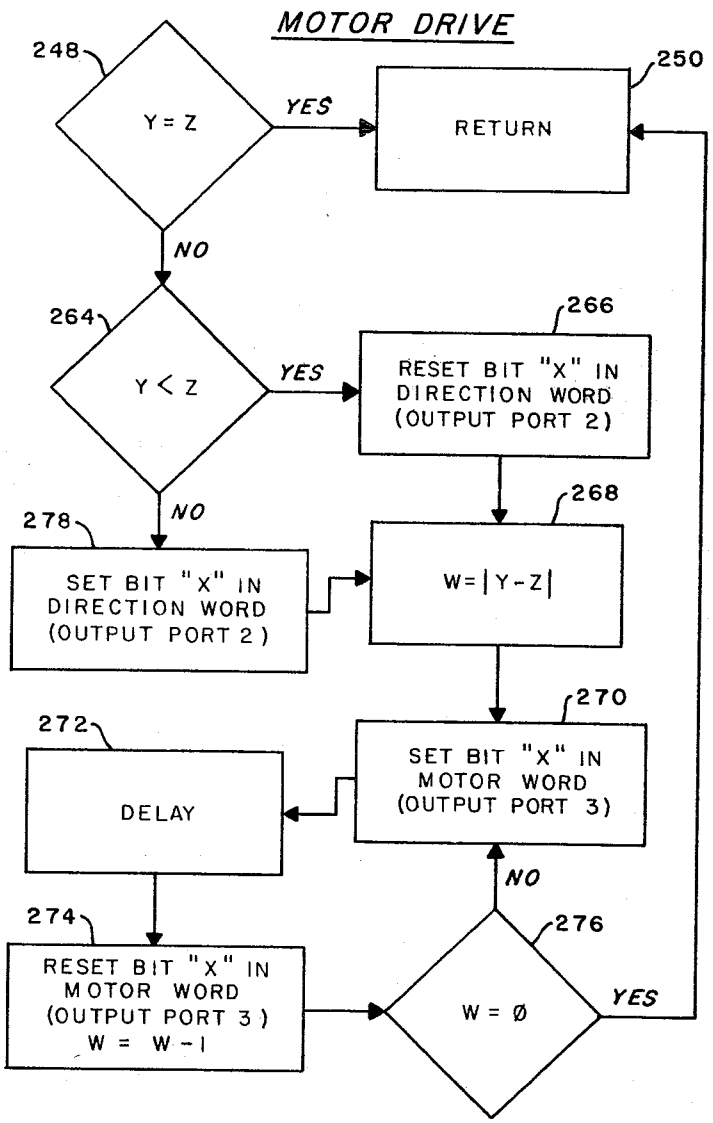
Figure 17:
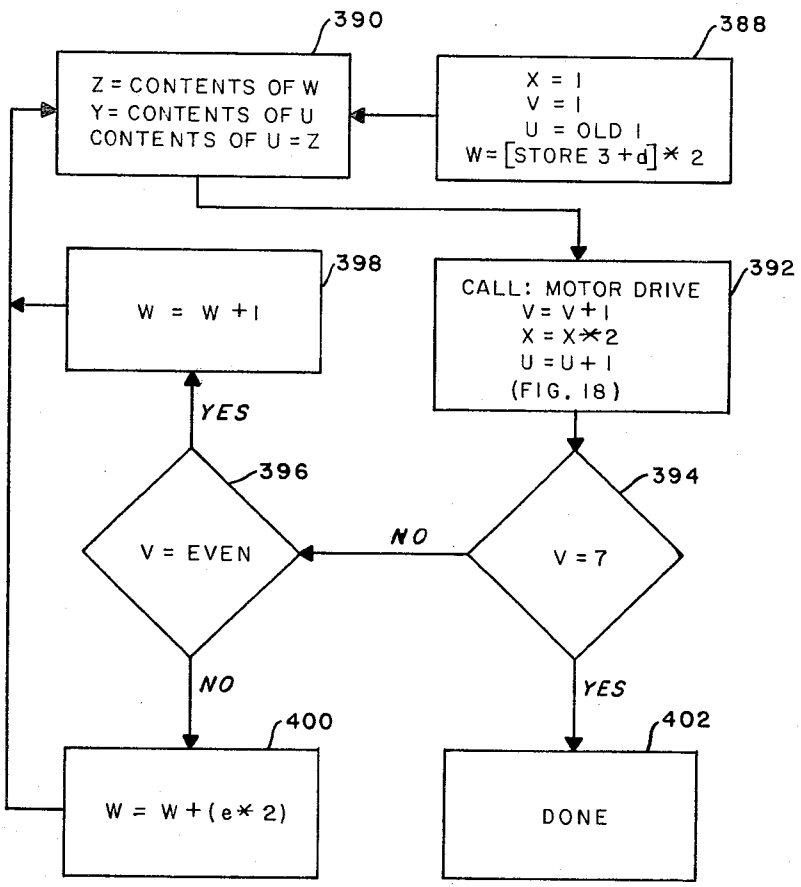

The microprocessor 142 then enters an OUTPUT TO MOTORS routine represented by block 178 and illustrated in detail in FIG. 17 wherein it utilizes the specific subset of contour profile data stored in the third array of the memory 156 corresponding to the incremental portions of the part located at the roller sets 22, 24 and brush pair 26 to adjust their positions by operation of the motors 132, 122 as per the subroutine MOTOR DRIVE of FIG. 18. Once these steps have been completed, the program returns the microprocessor 142 to the interrupt loop of block 162 where it awaits the next succeeding interrupt signal from the timer 144.

Initialization of Controller

The INITIALIZE MICROPROCESSOR routine of block 160 of FIG. 5 is shown in more detail in FIGS. 6 through 9. In accordance with block 180, the mathematical base for decimal calculations by the ALU of the microprocessor 142 is set up. Also, pointers are set up to be at the starting locations of the previously-mentioned first and third arrays of data memory 156. STORE 1 is the pointer in the first array, and STORE 3 is the pointer in the third array. The interrupt timer 144 as per block 182 is set up by storing a particular value or number therein which will determine how far the timer will count before it generates an interrupt signal to the microprocessor 142.

An important part of the initialization procedure is the performance of three consecutive tests depicted generally by blocks 184, 186 and 188 for checking the data memory 156, program memory 154 and light emitters and detectors of banks 134, 138 and 136, 140. Checking of the RAM data memory is carried out as per the procedure set out in the RAM OK? subroutine depicted in FIG. 7. Checking of the ROM program memory 154 is carried out in accordance with the procedure described in the ROM OK? subroutine of FIG. 8. Checking of the condition of the lights in the first and second banks is performed as per the procedure of the LIGHTS OK? subroutine of FIG. 9. Should any one of these successively-performed tests fail, the routine branches immediately to a POWER DOWN subroutine as per block 174 of FIG. 6 which is illustrated in detail in FIG. 10. If all three tests are passed, then the routine enters ENABLE INTERRUPTS as per block 190 which is a single instruction command that allows the microprocessor 142 to be interrupted by a signal from the timer 144. Finally, the block 192 captioned CONTINUE is reached which means that the initialization procedure is complete and the microprocessor 142 has entered the interrupt loop of block 162 of FIG. 5 where the microprocessor 142 awaits an interrupt signal from the timer 144.

Figure 6:
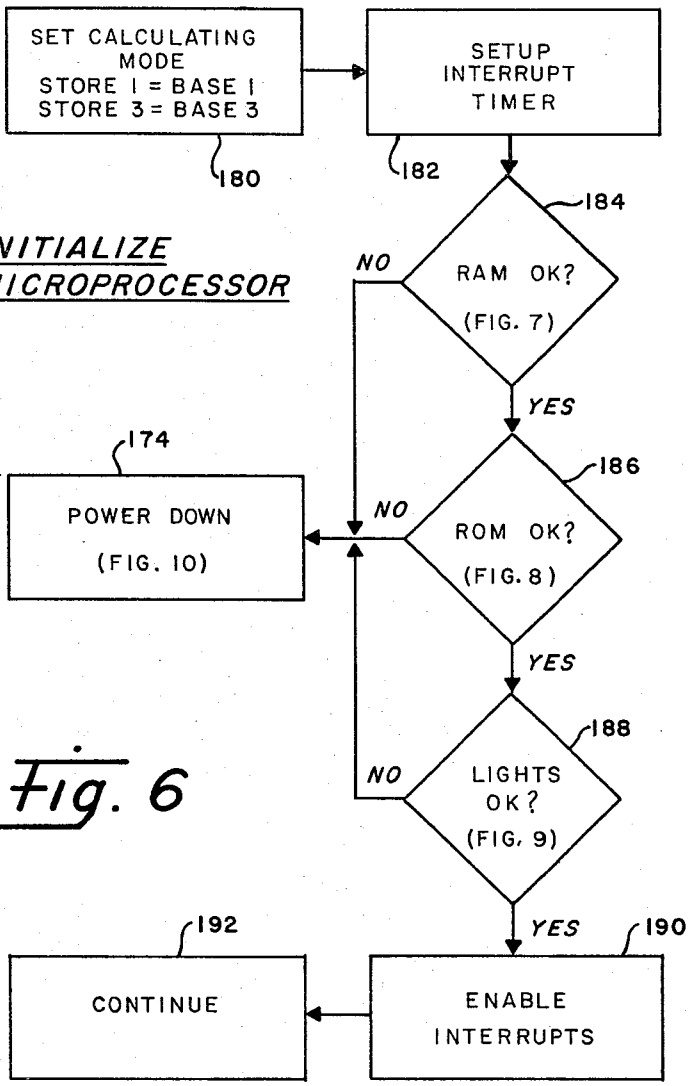
Figure 7:
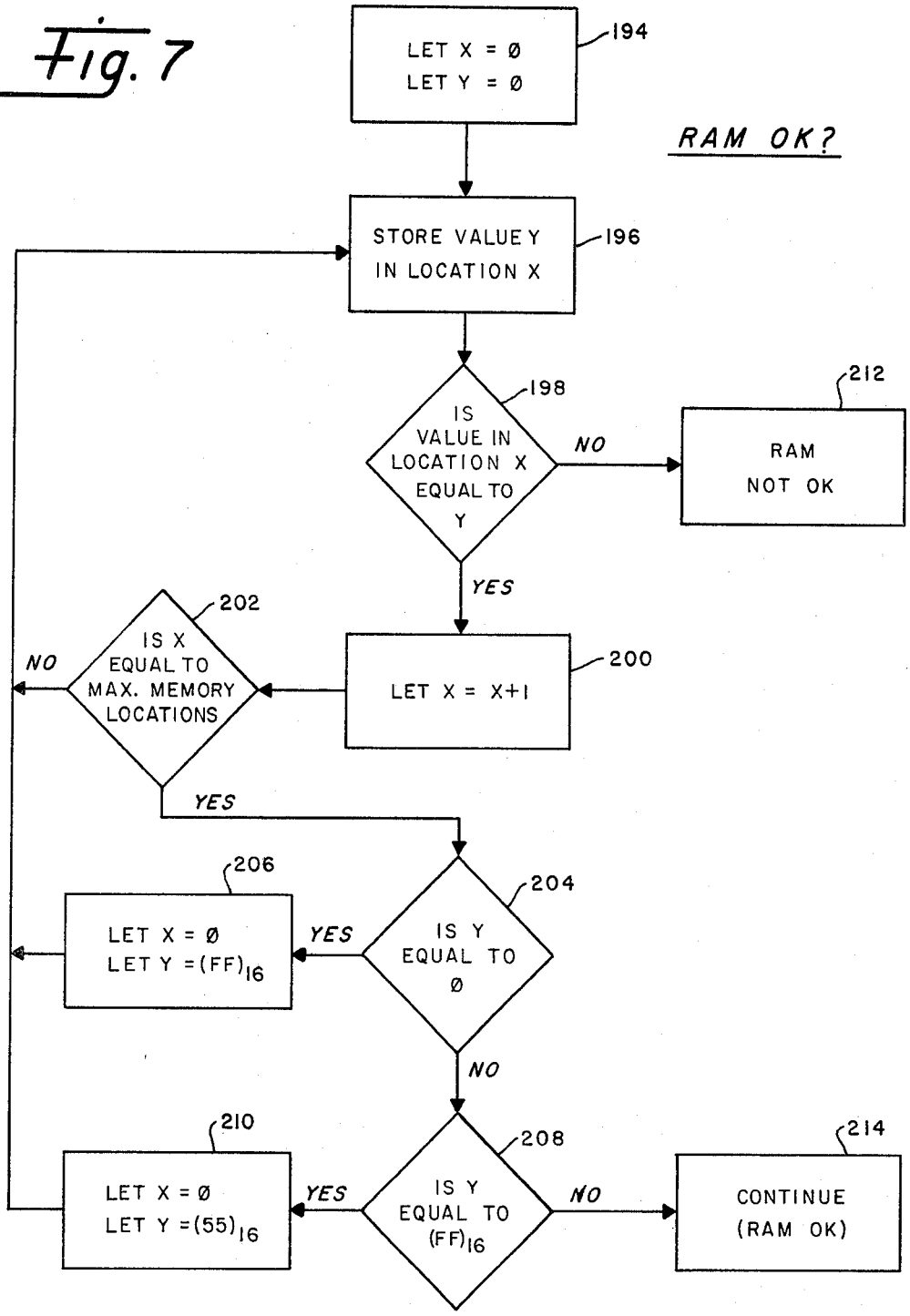

Turning now to a detailed description of the subroutines carried out during initialization, the RAM OK? subroutine of FIG. 7 will be considered first. It will be recalled that the data memory 156 includes a block of memory locations divided into three different arrays. The purpose of this subroutine is to make sure that the memory locations of this block are working. By "working" it is meant that the microprocessor 142 should read back from a memory location the same value as was previously written there. In this subroutine, three numbers are consecutively stored in each byte of memory. First, as per block 194 the number zero (0) is stored in each byte of memory, read back, and compared with the value that was previously stored until all bytes of memory have been tested. These steps are depicted in blocks 196, 198, 200 and 202. If this first portion of the test is successful as per block 204, then the sequence of steps is repeated for the number $(FF)_{16}$ as per block 206. Finally, if this second portion of the test is successful as per block 208, then the sequence of steps is repeated for the number $(55)_{16}$ as per block 210. If the test fails in the testing with any one of these three numbers, then the subroutine branches via RAM NOT OK block 212 to the POWER DOWN subroutines of FIG. 10, also generally shown as block 174 in FIG. 6. On the other hand, if the test is successful, the subroutine branches back via CONTINUE block 214 to the INITIALIZE MICROPROCESSOR routine of FIG. 6.

Figure 8:
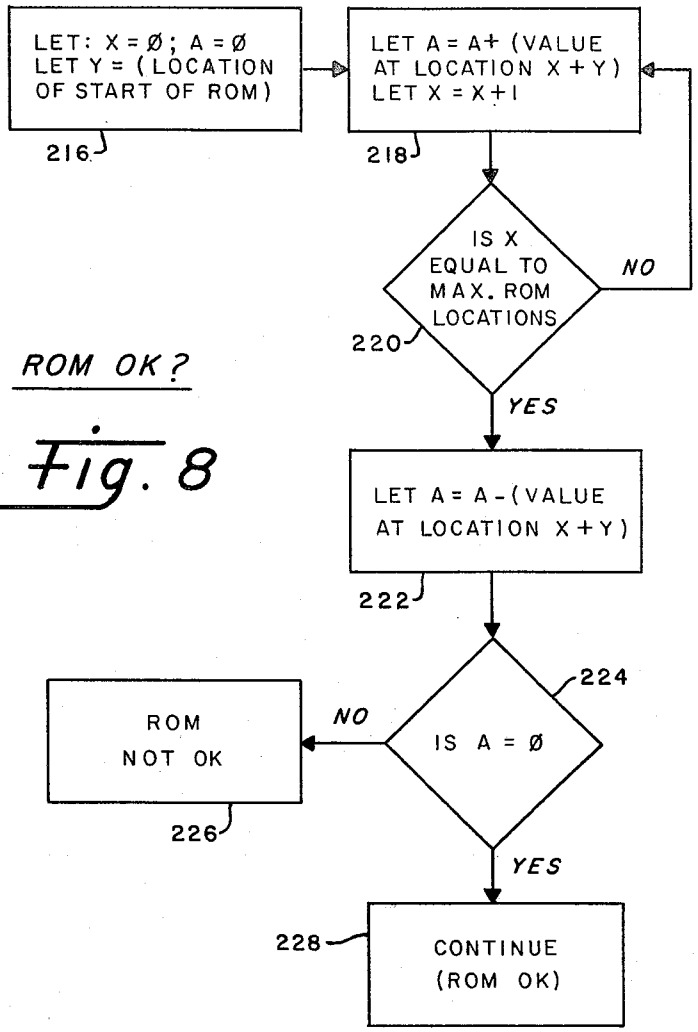

Upon passing the testing of data memory 156 as just described, the INITIALIZE routine of FIG. 6 enters the RAM OK? subroutine of FIG. 8. Recall that the microcomputer program is permanently stored here in read-only memory. A conventional ROM check is performed. When the program was installed in the program (ROM) memory 154, the last byte of memory contains the ones complement of a checksum value. The checksum is the total accumulated value reached by adding all of the values stored in the program memory locations. Blocks 216, 218 and 220 indicate that, beginning at the starting location of the ROM, all stored values are added together for all locations therein. Then, as per block 222, the subroutine will add the checksum complement in the last byte of ROM to the sum of all stored values. If the result does not equal zero as per block 224, then the test of the program memory 154 fails and the subroutine branches via ROM NOT OK block 226 to the POWER DOWN subroutine of FIG. 10. On the other hand, if the test is successful (the result as per block 224 equals zero), then the subroutine branches back via CONTINUE block 228 to the INITIALIZE MICROPROCSSOR routine of FIG. 6. If the test is to be successful, the result (A) in block 224 should equal zero since, in effect, the checksum is being added to its complement.

Figure 9:
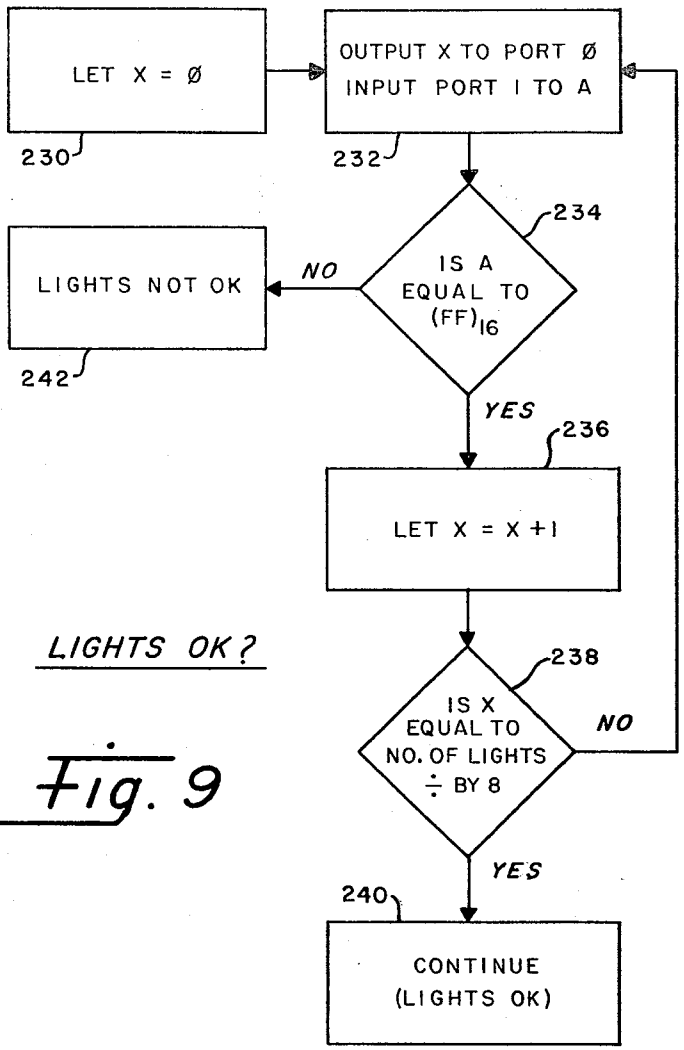

When program memory 154 has passed the test as just described, the INITIALIZE routine of FIG. 6 enters the LIGHTS OK? subroutine of FIG. 9. The purpose of this check is to ensure that all pairs of light emitters and detectors, in the preferred embodiment numbering two hundred fifty-six, are conducting, that is, each light detector is receiving light from its corresponding light emitter. The microprocessor 142 reads the lights in groups of eight lights at a time and after each reading checks to see if all lights have been read. These steps are being carried out in blocks 230, 232, 234, 236 and 238 of FIG. 9. In block 234 the program is checking to see if each bit of the byte is a one (1). That means that a particular pair of emitter and detector is conducting. The number $(FF)_{16}$ is the equivalent of $(11111111)_2$. If all lights are conducting, each group read by the microprocessor 142 as per block 234 will be represented by the number $(FF)_{16}$. Referring now to block 238, in the preferred embodiment when $X=32$ (the total number of lights divided by eight lights per group) then all lights have been read. If all lights were found to be conducting, the subroutine then branches back via CONTINUE block 240 to the INITIALIZE MICROPROCESSOR routine of FIG. 6. If at least one light was found to be not conducting, then the result of the comparison performed as per block 234 would be unequal and the subroutine would have branched via LIGHTS NOT OK? block 242 to the POWER DOWN subroutine of FIG. 10.

Figure 10:
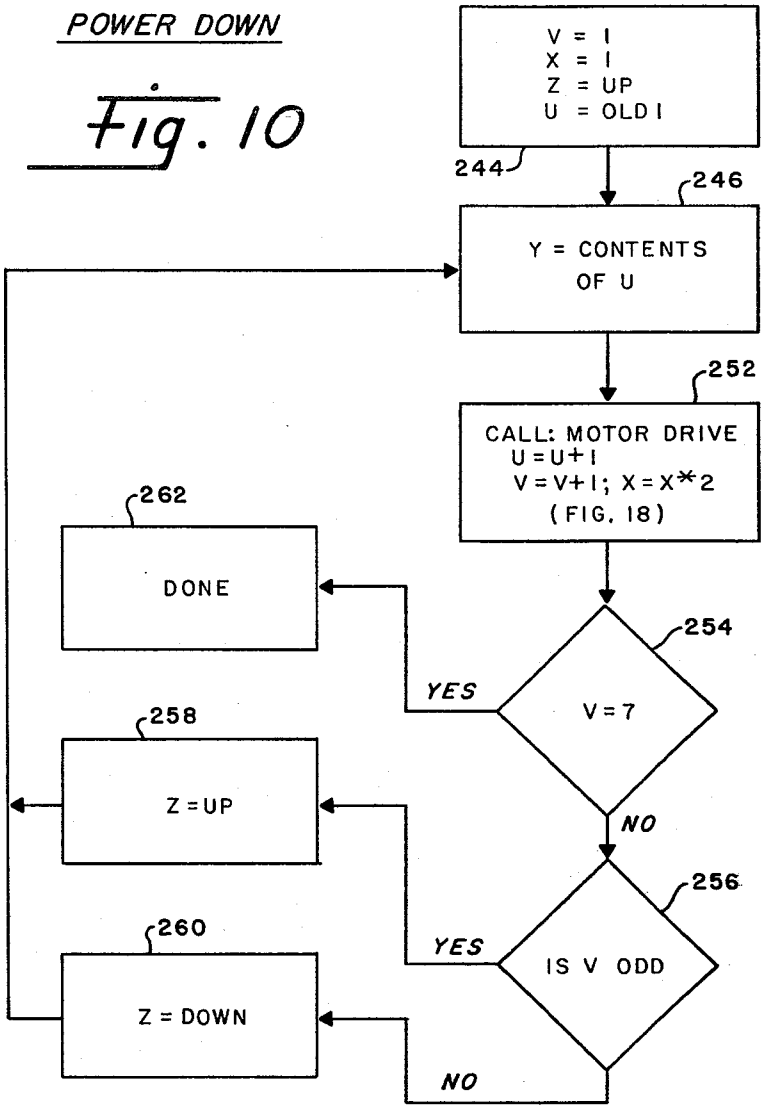

Before concluding the discussion of the INITIALIZE MICROPROCESSOR routine, it would be beneficial to describe the POWER DOWN and MOTOR DRIVE subroutines in detail by reference to FIGS. 10 and 18, respectively. The goal of the POWER DOWN subroutine of FIG. 10 is to actuate all of the motors 122, 132 so as to drive the upper brush 60 and rollers 52, 56 to their maximum up positions and to drive the lower brush 62 and rollers 54, 58 to their maximum down positions. In other words, the opposing rollers and brushes are driven apart to the maximum extent possible. This allows any part to continue through the station without any possible obstruction by the rollers or brushes.

In block 244 of the POWER DOWN subroutine, the letter "V" equals the actual number of the six motors for driving the brushes and rollers up and down through upper and lower telescoping supports 108, 128 and 110, 130. The upper motors 132, 122, 132 for respective upper roller 52, brush 60 and roller 56 are odd numbered 1, 3 and 5, while the lower motors 132, 122, 132 for respective lower roller 54, brush 62 and roller 58 are even numbered 2, 4 and 6. Thus "V" will equal one of the numbers 1 through 6 depending upon which motor is being driven at any given time. The letter "X" is the hexidecimal numerical designation for each of the six motors as follows: motor 1 is $(01)_{16}$; motor 2 is $(02)_{16}$; motor 3 is $(04)_{16}$; motor 4 is $(08)_{16}$; motor 5 is $(10)_{16}$; and motor 6 is $(20)_{16}$. Further, there are six values stored in data memory 156 which represent where each of the particular rollers and brushes are located at any one time. These six values will change. The letter "U" points to the first (OLD 1) of these six values which is the one designating the position of the upper roller 52 associated with motor 1. The letter "Z" represents the numerical value of the full UP and DOWN positions of the corresponding upper and lower rollers and brushes. The value at Z will be different for the UP positions and the DOWN positions, and Z will switch back and forth between these values as the value of V cycles successively from motor 1 to motor 6 during operation of the subroutine.

In block 246, the value of U is read (as Y) to determine where the upper roller 52 is positioned. Then, the POWER DOWN subroutine branches to block 248 of the MOTOR DRIVE subroutine of FIG. 18. If it is found by comparing the value of Y (the old position) and Z (the full UP position) as per block 248 that the roller 52 is already positioned at its full UP position (where $Y=Z$), then the roller 52 does not need to be moved and the program via RETURN block 250 merely branches back to block 252 of the POWER DOWN subroutine of FIG. 10.

At block 252 of the POWER DOWN subroutine, the values of U and V are indexed up by one and the value of X is shifted one bit to the left to become number $(02)_{16}$. This sets up the subroutine for operation on lower motor 2. Blocks 254 and 256 are successive checks made to determine whether all motors have cycled through the program and whether the next motor to be operated on is odd or even numbered in order to know to which value Z should now be set (see blocks 258 and 260) before returning to block 246 wherein the stored value of the old position of the lower roller 54 is read and the procedure is repeated for lower motor 2. Once the program has cycled through all six stepping motors, the value of V will equal seven at block 254 and then the subroutine will be finished as indicated by block 262 captioned DONE and then POWER DOWN of the apparatus completed.

If it had been found at block 248 of the MOTOR DRIVE subroutine of FIG. 18 that the upper roller 52 was not positioned at its full UP position (Y not equal to Z), then the condition at block 264 ($Y<Z$) would be answered YES and the subroutine would enter block 266. The instruction in block 266 commands the microprocessor 142 to set up the individual control of upper motor 1 via a particular signal on line 124 of FIG. 4 so that the motor will operate to move the roller 52 upward. The length of distance it is moved upward is determined by the value of W which is arrived at by the calculation called for in block 268. The number of increments there are between the old position value, Y, and the desired new or full UP position value, Z, are calculated and the microprocessor 142 as per block 270 pulses the motor 1 via line 126 to drive the motor through the calculated number of increments. There is a delay as per block 272 after each incremental pulse to allow time for the mechanical motion of roller movement to be completed. Blocks 274 and 276 complete a loop formed with blocks 270 and 272 within which the program cycles until all incremental movements of motor 1 and roller 52 have been completed (at which time the answer to block 276 is YES). Then the program via RETURN block 250 branches back to block 252 of the POWER DOWN subroutine of FIG. 10.

When even numbered motor 2 for lower roller 54 is operated on next by the program and found not to be at its full DOWN position, the answer to block 248 of the MOTOR DRIVE subroutine of FIG. 18 is NO and the block 278 is entered because the condition at block 264 is also answered NO. The instruction at block 278 commands the microprocessor 142 to set up the individual control for lower motor 2 by a signal on line 124 of FIG. 4 that is opposite in state to that of the signal used for setting up motor 1 so that motor 2 will operate to move the roller 54 downward. The distance it is moved downward is determined by the value of W which is arrived at, as explained above, by the calculation indicated in block 268. Recall that the value of Z for motor 2 will be different than before in the case of motor 1. Also, the value of Y will likely be different than before. The program cycles through the loop defined by blocks 270 through 276, as explained above, until W equals zero as per block 276, whereupon the program branches back to block 252 of the POWER DOWN subroutine for repetition of the sequence for motors 3 through 6 until POWER DOWN is completed when DONE block 262 is entered.

Read and Store First and Second Light Bank Data

Figure 13:
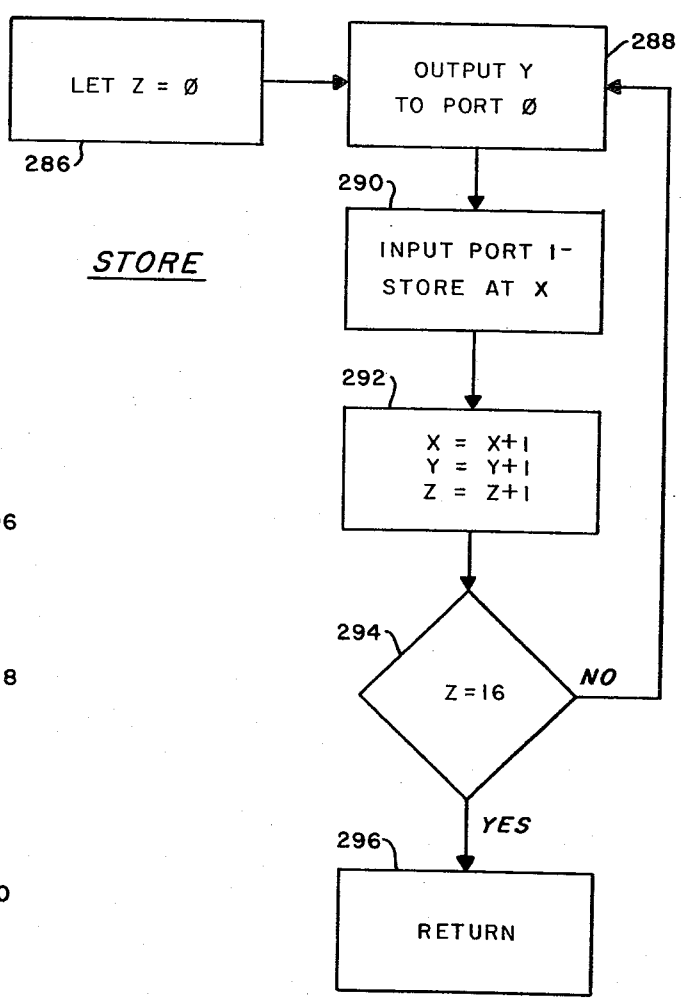

With the INITIALIZE MICROPROCESSOR sequence completed and when an interrupt signal is received by the microprocessor 142 from the timer 144 of line 280, the READ AND STORE LIGHTS (BANK 1) routine as per block 164 in FIG. 5 is entered. This routine is illustrated in detail in FIG. 11. The lights of the first bank 138 are read in and stored in the first array of data memory 156 using "STORE 1" as a pointer. The lights are read and stored in groups of eight lights at a time. Letting Y equal zero as per block 282 means to start reading in the first group of eight lights in the first bank 138. The STORE subroutine of FIG. 13 is called when block 284 of the FIG. 11 routine is entered.

The STORE subroutine at blocks 286, 288 and 290 causes the microprocessor 142 to read in a group of 8 lights starting with the group indicated at Y and place the byte into the first memory address pointed to by X in the first array of memory 156. The values of X, Y and Z are indexed by one as per block 292 and the value of Z is checked as per block 294. The answer to block 294 is NO until Z equals sixteen. (Z is set equal to the total number of lights per bank divided by the number of lights in the group checked simultaneously.) In the preferred embodiment, Z equals one hundred twenty-eight lights per bank divided by eight lights per group. Once the answer to block 294 is YES (when Z equals sixteen), the STORE subroutine branches via RETURN block 296 back to block 284 of the READ AND STORE LIGHTS (BANK 1) routine of FIG. 11.

Figure 11:
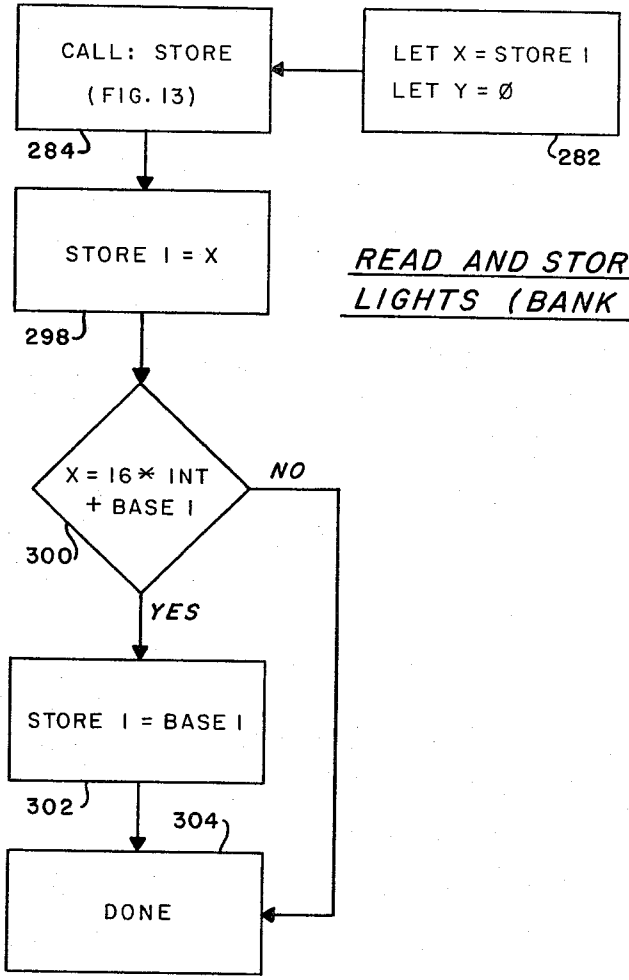

The FIG. 11 routine now continues by resetting the pointer for the next interrupt and by determining whether the end of the first array has been reached. The steps are depicted by blocks 298, 300 and 302. In block 300, INT is equal to the number of one-sixteenths of an inch increments between t' first and second light banks 138, 140 plus one extra one-sixteenth inch increment. This is the same as the number of timer interrupts between the first and second light banks plus one. The pointer is wrapped around to the beginning of the first array if the end thereof has been reached. Once the above steps have been completed the program via DONE block 304 of FIG. 11 enters the READ AND STORE LIGHTS (BANK 2) routine generally depicted by block 166 in FIG. 5 and in detail in FIG. 12.

Figure 12:
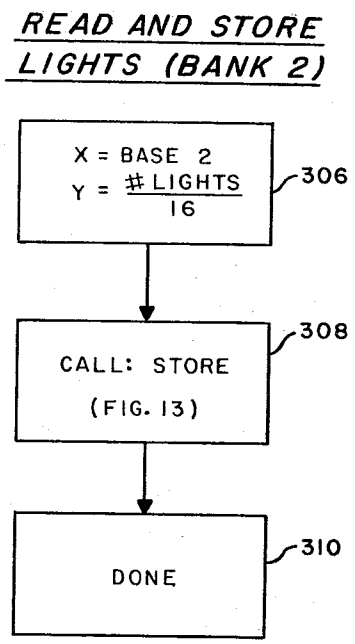

The routine of FIG. 12 is generally similar to that of FIG. 11 but in abbreviated form since the states of the lights in the second bank 140 are only stored in the second array of data memory 156 for one cycle of the program. Here, the pointer into the second array is always equal to its base location as stated in block 306. Since in the preferred embodiment the total number of lights to be read is two hundred and fifty-six, the starting value of Y in block 306 is sixteen which means to start reading the first group of eight lights in the second bank 140. (The groups of lights in the first bank 138 are assigned numbers zero through fifteen.) From block 306, the program branches to the STORE subroutine of FIG. 13 called as per block 308 of the routine of FIG. 12. The operation of the STORE subroutine in connection with reading and storing the lights of the second bank 140 is the same as described above in reference to the light of the first bank 138 and therefore the description thereof need not be repeated. Once the STORE sequence is completed, the routine of FIG. 12 enters the DONE block 310 and continues to the COMPARE LIGHTS (t) routine generally illustrated as block 168 in FIG. 5 and in detail in FIG. 14.

Compare First and Second Light Bank Data

Figure 14:
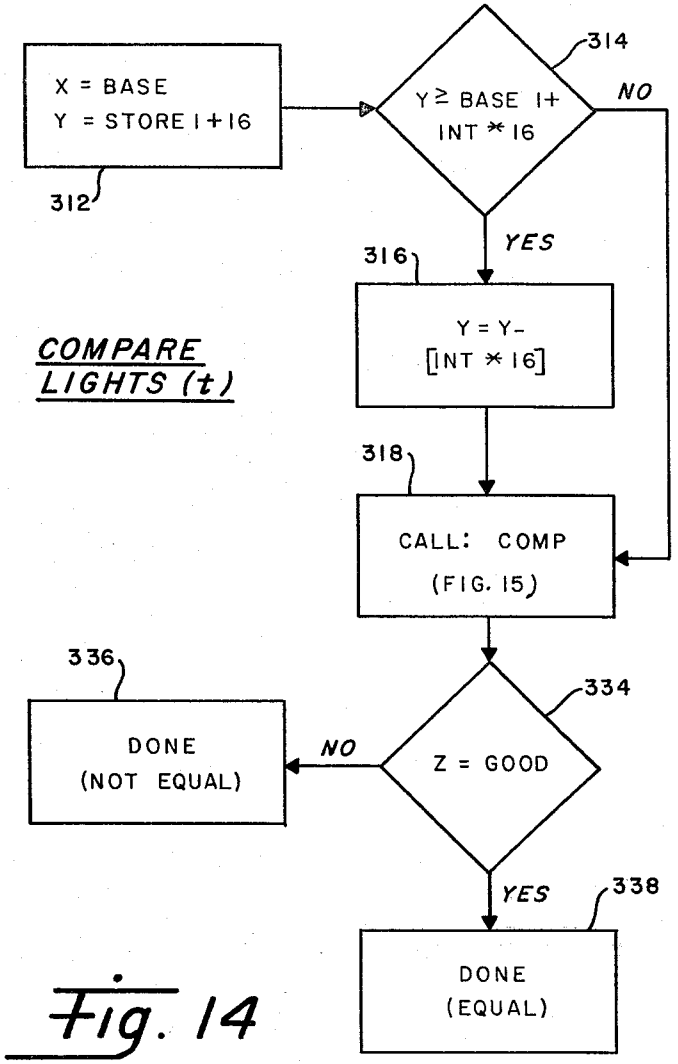

In the COMPARE LIGHTS (t) routine of FIG. 14, the states of the light detectors of the second sensor bank 140 just read and stored are compared with the states of the light detectors of the first sensor bank 138 at some predetermined "t" time ago, where "t" is the time equivalent of the distance between the banks in one-sixteenths of an inch increments. As presented in block 312, Y is the address of the correct block of sixteen values (bytes) in the first array of data memory 156 which is going to be compared with the single block of sixteen values (bytes) from the second array of memory 156 at address X. Before entering the COMP sequence, a check is made, as per blocks 314 and 316, for overflow and to reset the pointer to the correct block of first array memory if overflow has occurred. If no overflow is found, then the COMP subroutine of FIG. 15 is called by block 318 of the FIG. 14 routine.

Figure 15:
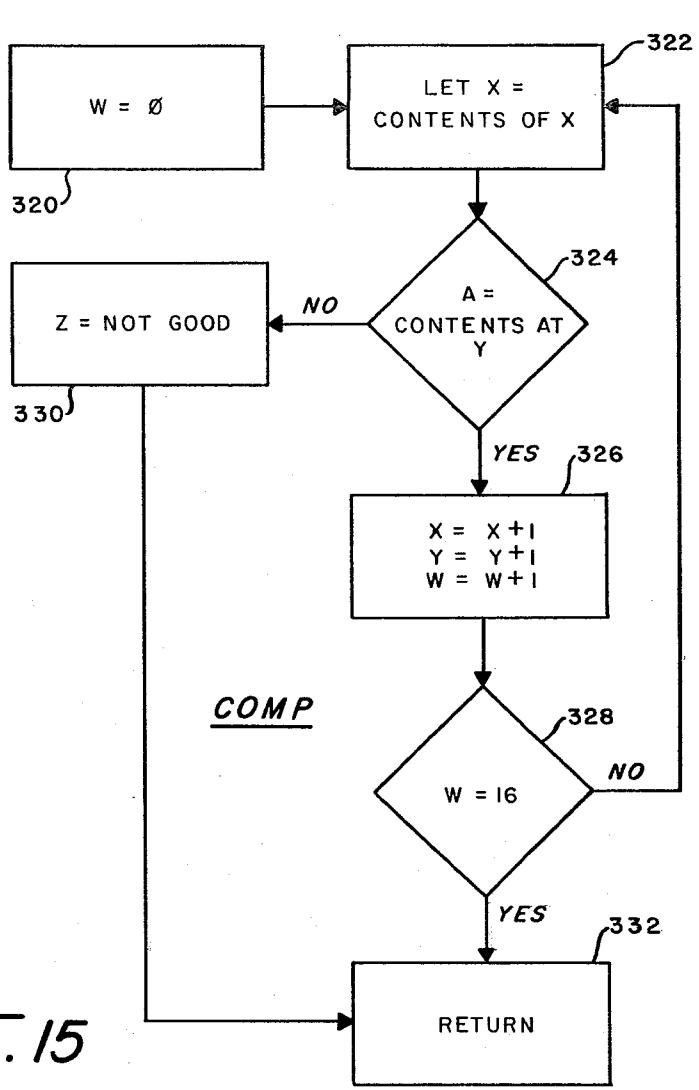

The COMP subroutine of FIG. 15, in the preferred embodiment, basically says compare the sixteen values (bytes) stored in the second array starting at X with the next sixteen values (bytes) stored in the first array starting at Y. Sixteen comparisons will be successively made if all comparisons prove to be good (the values at X equal the values at Y). The comparisons are terminated whenever one is found not to be good. The variable W is counting the number of comparisons. (W equals the number of lights per bank divided by the number of lights per group.) It is set equal to zero in block 320. Blocks 322, 324, 326 and 328 form a loop within which the program cycles, comparing corresponding bytes at X with bytes at Y, indexing the values of X, Y and W by one per each cycle of the loop, and checking whether the number of comparisons has reached sixteen. IF at any time the comparison fails in block 324, then the block 330 captioned Z=NOT GOOD is entered and the COMP subroutine operation is aborted.

The program then branches back via RETURN block 332 to block 318 of the COMPARE LIGHTS (t) routine of FIG. 14. The same occurs if all comparisons are successful. However, when the routine of FIG. 14 enters the Z=GOOD block 334, the answer will be different depending upon whether the comparisons made by the COMP subroutine were all successful or not. If not successful, then the DONE (NOT EQUAL) block 336 is entered and the program proceeds to COMPARE LIGHTS (t−1) as per block 170 in FIG. 5. If the comparisons are all successful, then the DONE (EQUAL) block 338 is entered and the program proceeds to the CONVERT AND STORE LIGHTS routine of FIG. 16A.

The COMPARE LIGHTS (t−1) and COMPARE LIGHTS (t+1) routines, generally depicted in blocks 170 and 172 in FIG. 5, are identical to the COMPARE LIGHTS (t) routine of FIG. 14, except for the initial address of the sixteen bytes stored in the first array, or the value of Y in block 312 of FIG. 14. In the COMPARE LIGHTS (t−1) routine the Y value is STORE 1+32, while in the COMPARE LIGHTS (t+1) routine the Y value is STORE 1. Since the remainder of these routines are identical to the sequence of steps described for the COMPARE LIGHTS (t) routine of FIG. 14, they need not be described again. Suffice it to say that if the first comparison performed by the routine of FIG. 14 produces a match or condition of equality between the two sets of data, then the microprocessor 142 enters the CONVERT AND STORE LIGHTS routine as per block 176 in FIG. 5. The necessity for the second and third comparison by the COMPARE LIGHTS (t−1) and (t+1) routines would be obviated. However, if the first comparison did not produce a match through operation of the FIG. 14 routine, the (t−1) routine would next be entered, and if not successful, then the (t+1) routine would be entered. If neither of the latter two routines result in successful comparisons, then the POWER DOWN subroutine will be entered and carry out steps directed toward terminating operation of the apparatus 10, as previously described.

Compact Data and Store Bottom and Top Contour Profile Values

Figure 16A:
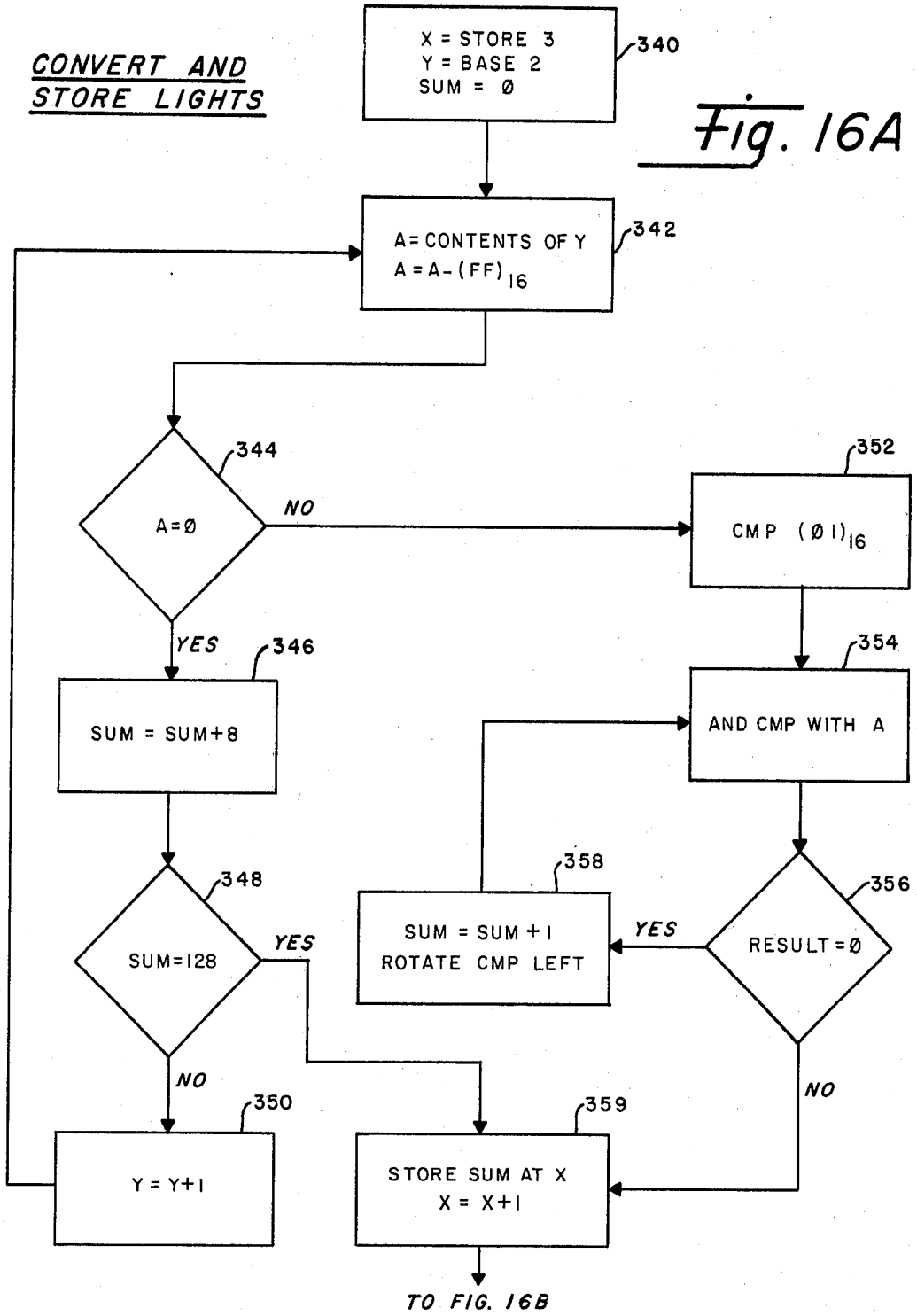
Figure 16B:
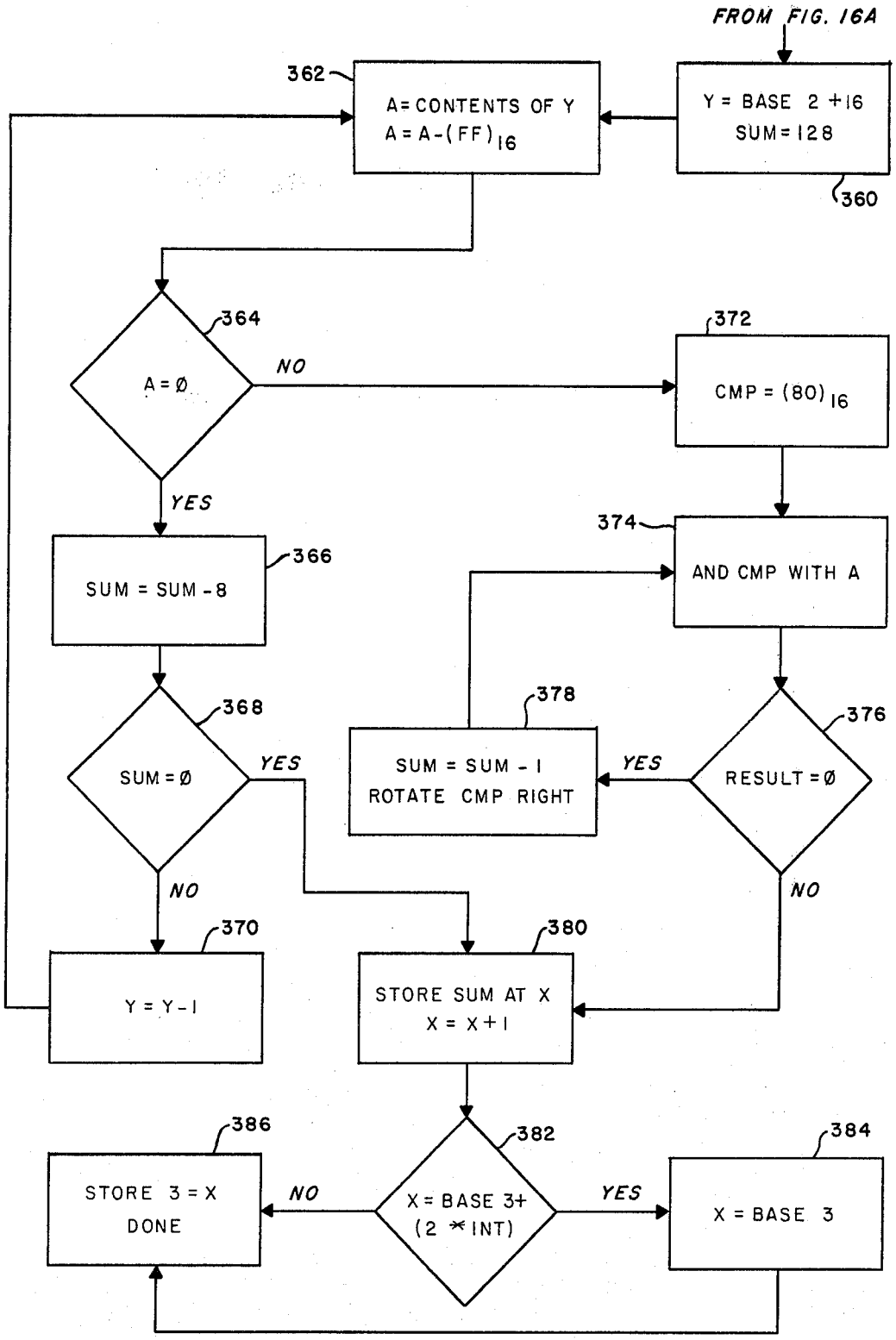

The purpose of the CONVERT AND STORE LIGHTS routine, generally depicted by block 176 in FIG. 5 and in detail in FIGS. 16A and 16B, is to determine two values, one representing the bottom boundary point of the part contour profile and the other representing the top boundary point of the part contour profile. These two values (called "compressed" or "compacted" values), are to be arrived at through inspection of the information or data stored in the second array of data memory 156 and then themselves stored in the third array. The portion of the routine illustrated in FIG. 16A is concerned with the steps for determining the bottom profile value of starting the inspection of the stored light state data at the memory location in the second array representing the lowest light in the second bank 140. The portion of the routine illustrated in FIG. 16B is concerned with the steps for determining the top profile value by starting the inspection of the stored light state data at the memory location in the second array representing the highest light in the second bank 140.

Turning first to FIG. 16A, in block 340 X is a pointer to the location in the third array of data memory 156 where the bottom profile boundary value will be stored once it is determined, Y is the address of the first byte of light state data in the second array to be inspected, and SUM is the first compacted value representing the bottom profile boundary point. It is initially set equal to zero to indicate that the inspection is starting from the bottom light detector and proceeding up. At block 342 the light state data is read out of the second array of memory one byte at a time and inspected to determine whether all eight bits are ones, which they will be if all eight light detectors of the group are conducting. The inspection is performed by subtracting the hexidecimal number $(FF)_{16}$, which is equivalent to binary number $(11111111)_2$, from the byte at the first memory location of the second array. As per block 344, if all eight light detectors of the group are conducting, meaning that the bottom profile boundary of the part was not intercepted by the eight light beams, then the answer is YES and block 346 is entered where eight is added to the old SUM of zero to form a new SUM equal to eight. At block 348, the new SUM is checked. If found equal to 128 that means that all light detectors of the second bank 140 have been checked since the top light detector is the one hundred twenty-eighth one. Since only the first group of eight light detectors out of sixteen groups has been inspected thus far, the answer at block 348 is NO and, at block 350, Y is indexed by one and the program loops back to block 342 where the second byte of light state data in the second array is inspected. If at block 344 it is found that new A (which equals old A-$(FF)_{16}$) does not equal zero, then this means that there is a nonconducting light detector among the eight light detectors of this second group. The program then shifts to block 352 where this second byte of data will be inspected bit by bit to find out which specific one of the light detectors was nonconductive.

At block 354, the hexidecimal number $(01)_{16}$ is ANDed with the light state data byte represented by new A. This, in effect, checks the rightmost one of the eight bits comprising new A to determine if it is a one. If it is a one, the answer to RESULT=0 block 356 is NO, since a one ANDed with a one equals one, not zero. If the rightmost bit is equal to zero, then the result of the AND operation will be zero and the answer to block 356 will be YES. Then, as per block 358, the SUM which was equal to eight is now indexed by one and the one bit in the hexidecimal number $(01)_{16}$ is rotated left to make CMP now equal to $(02)_{16}$. In this new number, the one bit is now located at the second position from the right. When it is ANDed with the light state data byte represented by new A, the next to the rightmost one of the eight bits is checked to determine if it is a one. Suppose it is a one. Then, as described above, the answer to block 356 will be NO and the first lower non-conducting one of the light detectors in the second group has now been located. At block 359, a value (or SUM) representing the number of the light detector which is nonconducting (in the above example it was light detector nine, where the lowest one is numbered zero) is stored at location X in the third array and the pointer X into the third array is then indexed by one to designate the location where the top profile boundary value, on the second "compacted" value, will be stored once it is determined.

The program then enters block 360 of the FIG. 16B portion of the CONVERT AND STORE LIGHTS routine. This portion of the routine is very similar to that of FIG. 16A, except that Y in block 360 is now the address of the last byte of light state data in the second array to be inspected and SUM is the second compacted value representing the top profile point. It is initially set equal to one hundred twenty-eight to indicate that the inspection is starting from the top light detector of the second bank and proceeding down. Blocks 362 and 364 are the same as earlier blocks 342 and 344 of FIG. 16A. Block 366 involves subtracting eight from SUM (or 128 at the start) since the stored data representing the uppermost group of eight lights is being inspected first. When the SUM=0 is reached as per block 368, that means that all light state data from top to bottom have been inspected. In block 370, Y is decremented by one since its starting point was at the "top" end of the second array instead of the "bottom" end as was the case in FIG. 16A.

When the program shifts to block 372 upon determination at block 364 that the new A(which equals old A—$(FF)_{16}$) contains a one bit due to the presence of a nonconducting light detector, a hexidecimal number $(80)_{16}$, or binary $(10000000)_2$, is ANDed with the new A byte at block 374 to first check whether the leftmost bit of the new A byte is a one or zero. If it is a zero, then the answer to block 376 is YES and the program enters block 378 where the SUM is decremented by one and the hexidecimal number CMP is rotated right to form number $(40)_{16}$. This new number is ANDed with the new A byte at block 374 and the program proceeds as before to block 376. If the second bit from the left of the new A byte is a one, then the answer to block 376 is NO and the program then enters block 380. The same operations occur here as at block 359 in FIG. 16A. The SUM representing the first nonconducting upper light detector, or the second "compacted" value, is stored at location X in the third array and the pointer X into the third array is then indexed by one for the next time this routine is operated. The last three blocks 382, 384 and 386 prescribe a check to determine whether the end of the third array has been reached and, if so, the pointer will be wrapped around to the start of the array. After this, the routine is DONE as per block 386 whereupon the program moves into the OUTPUT TO MOTORS routine as per block 178 in FIG. 5.

Operate Motors to Properly Adjust Positions of Rollers and Brushes

The OUTPUT TO MOTORS routine generally shown by block 178 of FIG. 5 and illustrated in detail in FIG. 17 is generally similar to the POWER DOWN subroutine of FIG. 10 which has been described. There are several differences, however. In the FIG. 10 POWER DOWN routine the objective was to operate the six stepping motors 122, 132 so as to move the upper brush and rollers to their full UP positions and drive the lower brush and rollers to their full DOWN positions. Now, the objective is to operate each respective stepping motor to move its respective brush or roller to the position corresponding to the compacted value which was calculated and stored in the thrd array of the data memory 156, as just previously described.

Referring first to block 388, W is a pointer into the third array to value of the number of increments which the motor 1 will need to be pulsed in order to correctly position upper roller 52. The "d" is the number of increments of distance between the second light bank 140 and the upper roller 52 in one-sixteenth inch increments. The values of X, V, and U are the same as in the case in the POWER DOWN routine. However, now in block 390, Z is set equal to the contents of W, instead of previously where Z equaled either full UP or DOWN in the POWER DOWN routine. Y is the same as before, equal to the contents of U. However, now U, the old value, is set to the new value, Z. This new value will become the old value for the next time the motor 1 is operated. The program then enters block 392 where the MOTOR DRIVE subroutine of FIG. 18 is called. The subroutine operates here in a manner identical to that previously described in connection with the description of the POWER DOWN routine so an explanations of its operation need not be repeated. After the motor 1 has been operated to move the upper roller 52 to its new position and the subroutine has branched back to block 392 of the OUTPUT TO MOTORS routine, the program then enters block 394. Here a check is performed to determine whether operations on all motors have been completed. If not, then the program moves to block 396. Here a check is made to determine whether the next motor is odd or even numbered. If it is even, then it is the lower motor for the opposite roller or brush and its value is stored in the next adjacent location, W+1, of the third array, as per block 398. However, if it is odd, then it is the upper motor for the upper roller or brush of the next pair thereof and its value is stored in the third array as per block 400. The "e" in block 400 equals the number of one-sixteenth inch increments from the previous roller pair 22 to the next brush pair 26. Therefore, "e*2" is the number of storage value pairs between the two in the third array of data memory 156. From either of block 400 or block 398 the steps of the routine are repeated. If at block 394 it is determined that operations on all stepping motors have been completed (the answer is YES to the block 394), then the program enters the DONE block 402 and branches back to the INTERRUPT block 162 where it loops until the next interrupt signal is received by the microprocessor 142 from the timer 144.

The description of the program has now been completed. It will be readily seen that the program can be slightly modified to accommodate a different number of lights per bank than one hundred and twenty-eight and a different number of lights in the group which are read simultaneously than eight. Furthermore, it should be understood by increasing the number of lights in each bank and the capacity of data memory 156, parts having heights greater than eight inches may be accommodated by the apparatus. It is thought that the contour deburring apparatus of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. Apparatus for contour deburring of parts having varying sizes and shapes, comprising:

a. a part deburring station having an entrance and exit;

b. means located adjacent the entrance of said station for feeding a part into said station;

c. means located adjacent the exit of said station for transporting the part from said station;

d. means positioned adjacent said part feeding means for sensing the contour profile of the part being fed into said station;

e. means mounted in said station for gripping the part and simultaneously transferring it through said station from said part feeding means to said part transporting means;

f. means mounted in said station for deburring the part as it is being transferred through said station by said part gripping means; and g. control means interconnecting said part contour profile sensing means to said gripping means and to said deburring means and operable in response to said sensing of the contour profile of the part for adjusting said gripping means and said deburring means to accommodate the particular size and shape of the part as it is transferred through said station.

2. The contour deburring apparatus as recited in claim 1, wherein said means for deburring the part includes a pair of deburring brushes being mounted one above the other for independent movement toward and away from each other.

3. The contour deburring apparatus as recited in claim 2, wherein said means for deburring the part also includes:

a. means for independently moving said brushes toward and away from each other to position the same to accommodate the particular size and shape of the part being transferred through the station; and b. means for operating said brushes to cause deburring of the part simultaneously as the brushes move toward and away from each other.

4. The contour deburring apparatus as recited in claim 2, wherein said means for gripping the part includes first and second pairs of gripping rollers, said first pair of rollers being located between the entrance of said station and said pair of deburring brushes, said second pair of rollers being located between the exit of said station and said pair of deburring brushes, and said rollers of each pair thereof being mounted one above the other for independent movement toward and away from each other.

5. The contour deburring apparatus as recited in claim 4, wherein said means for gripping the part also includes:

a. first and second drive means connected respectively to corresponding first and second pairs of gripping rollers for independently moving said rollers of said corresponding pairs thereof toward and away from each other to accommodate the particular size and shape of the part being transferred through the station; and b. means for operating said rollers of each pair thereof to cause transferring of the part simultaneously as the rollers move toward and away from each other.

6. The contour deburring apparatus as recited in claim 1, wherein said means for sensing the contour profile of the part includes:

a. at least one bank containing a plurality of light emitters arranged in a generally vertical column and positioned at one side of said means for feeding the part into the station; and b. at least one bank containing a like plurality of light detectors arranged in a generally vertical column and positioned on an opposite side of said feeding means with each light detector being aligned with one of said light emitters.

7. The contour deburring apparatus as recited in claim 6, wherein said at least one bank of light emitters is comprised by first and second banks of said light emitters, and said at least one bank of light detectors is comprised by first and second banks of said light detectors.

8. The contour deburring apparatus as recited in claim 7, wherein said first bank of light emitters is aligned across said part feeding means with said first bank of light detectors, and said second bank of light emitters is aligned across said part feeding means with said second bank of light detectors, said second banks of emitters and detectors being disposed along the same sides of said part feeding means as, and the same distance from, said respective first banks of emitters and detectors.

9. The contour deburring apparatus as recited in claim 6, wherein said control means includes means for periodically reading said light detectors of said at least one bank thereof for repetitively determining the lowermost and uppermost ones of said light detectors that are not receiving light from their corresponding light emitters, said ones of said light detectors corresponding to the bottom and top contour profile boundary of the part being fed between said light emitter and detector banks.

10. The contour deburring apparatus as recited in claim 9, wherein said control means also includes means for repetitively determining the particular adjustment needed to be made to said gripping means and said deburring means in order for the same to accommodate the particular size and shape of the part being transferred through the station.

11. The contour deburring apparatus as recited in claim 8, wherein said control means includes means for periodically reading said light detectors of said first and second banks thereof and comparing the same to ensure that the lowermost and uppermost ones of said light detectors which are found not receiving light from their corresponding light emitters correspond to the bottom and top contour profile boundary of the part and not to some malfunction.

* * * * *